United States Patent [19]

Leone et al.

[11] 4,080,207

[45] Mar. 21, 1978

[54] RADIATION-SENSITIVE COMPOSITIONS AND PHOTOGRAPHIC ELEMENTS CONTAINING N-(ACYLHYDRAZINOPHENYL) THIOAMIDE NUCLEATING AGENTS

[75] Inventors: Ronald E. Leone, Rochester; James K. Elwood, Victor, both of N.Y.

[73] Assignee: Eastman Kodak Company, Rochester, N.Y.

[21] Appl. No.: 700,981

[22] Filed: Jun. 29, 1976

[51] Int. Cl.[2] ..... G03C 1/48; G03C 1/40; G03C 1/76; G03C 1/28

[52] U.S. Cl. ..... 96/73; 96/3; 96/29 D; 96/64; 96/76 R; 96/77; 96/95; 96/107

[58] Field of Search ..... 96/3, 29 D, 76 R, 77, 96/64, 107, 95, 73

[56] References Cited

U.S. PATENT DOCUMENTS

| | | | |
|---|---|---|---|
| 2,563,785 | 8/1951 | Ives | 96/64 |
| 2,588,982 | 3/1952 | Ives | 96/64 |
| 3,227,552 | 1/1966 | Whitmore | 96/3 |
| 3,367,780 | 2/1968 | Fix et al. | 96/107 |
| 3,615,615 | 4/1970 | Lincoln et al. | 96/107 |
| 3,718,470 | 2/1973 | Spence et al. | 96/64 |
| 3,719,494 | 3/1973 | Kurtz et al. | 96/107 |
| 3,734,738 | 5/1973 | Kurtz et al. | 96/107 |
| 3,759,901 | 9/1973 | Lincoln | 96/59 |
| 3,761,276 | 9/1973 | Evans | 96/76 R |
| 3,923,513 | 12/1975 | Evans | 96/76 R |

FOREIGN PATENT DOCUMENTS

| | | |
|---|---|---|
| 819,853 | 0000 | Belgium. |
| 1,335,851 | 10/1973 | United Kingdom. |

*Primary Examiner*—David Klein
*Assistant Examiner*—Richard L. Schilling
*Attorney, Agent, or Firm*—Carl O. Thomas

[57] ABSTRACT

Heterocyclic N-(acylhydrazinophenyl)thioamide nucleating agents are disclosed as well as radiation-sensitive compositions and elements containing such nucleating agents in combination with silver halide grains capable of forming an internal latent image. The elements can be used to form direct-positive photographic images. Dye image transfer photographic elements are specifically contemplated.

41 Claims, No Drawings

RADIATION-SENSITIVE COMPOSITIONS AND PHOTOGRAPHIC ELEMENTS CONTAINING N-(ACYLHYDRAZINOPHENYL) THIOAMIDE NUCLEATING AGENTS

The present invention is directed to novel photographic elements, radiation-sensitive compositions and novel photographic nucleating agents. More specifically, this invention is directed to nucleating agents of the hydrazine type and to radiation-sensitive compositions and photographic elements containing such nucleating agents in combination with silver halide grains capable of forming an internal latent image.

Photographic elements which produce images having an optical density directly related to the radiation received on exposure are said to be negative-working. A positive photographic image can be formed by producing a negative photographic image and then forming a second photographic image which is a negative of the first negative—that is, a positive image. The advantage of forming a positive photographic image directly has long been appreciated in the art. A direct-positive image is understood in photography to be a positive image that is formed without first forming a negative image.

A conventional approach to forming direct-positive images is to use photographic elements employing internal latent image forming silver halide grains. After imagewise exposure, the silver halide grains are developed with a surface developer—that is, one that will leave the latent image sites within the silver halide grains substantially unrevealed. Simultaneously, either by uniform light exposure or by the use of a nucleating agent, the silver halide grains are subjected to development conditions that would cause fogging of a negative-working photographic element. The internal latent image forming silver halide grains which received actinic radiation during imagewise exposure develop under these conditions at a slow rate as compared to the internal latent image forming silver halide grains not exposed. The result is a direct-positive silver image. In color photography oxidized developer that is produced during development is used to produce a corresponding positive dye image. Multi-color direct-positive photographic dye images based on the above-described "internal image reversal" process have been investigated extensively in connection with image-transfer photography.

The term "nucleating agent" is employed in its art-recognized usage to mean a fogging agent capable of permitting the selective development of internal image forming silver halide grains which have internal latent image sites but which have not been imagewise exposed, in preference to the development of silver halide grains having internal latent images formed by imagewise exposure. Nucleating agents are fogging agents which perform essentially the same function achieved by uniform light exposure during development in internal image reversal processes.

Substituted hydrazines have been extensively investigated as nucleating agents for forming direct-positive photographic images with internal image forming emulsions. Illustrative patents directed to the use of hydrazines in forming direct-positive photographic images are Ives U.S. Pat. Nos. 2,563,785 and 2,588,982 issued Aug. 7, 1951 and Mar. 11, 1952, respectively; Whitmore U.S. Pat. No. 3,227,552 issued Jan. 4, 1966; and Knott and Williams British Pat. No. 1,269,640 published Apr. 6, 1972. Ives as well as Knott and Williams teach the incorporation of their nucleating agents in photographic developers. The nucleating agents of Whitmore can be incorporated directly within a photographic element or in an image-receiving element as well as in the photographic developer. Whitmore teaches the use of substituted hydrazine nucleating agents in image-transfer type photographic elements.

In considering the formation of direct-positive photographic images using conventional substituted hydrazine nucleating agents of the type disclosed above by Ives, Whitmore and Knott et al, a number of disadvantages have been identified. One disadvantage has stemmed from the tendency of incorporated hydrazine derivatives when used in conventional quantities to liberate nitrogen gas in the course of nucleating silver halide. The liberated gas can result in bubbles being trapped within the binder for the photographic element. The bubbles can produce optical distortions or even cause discontinuities in one or more layers of the photographic element, thereby degrading the photographic image.

In recognizing the deficiencies of hydrazine-type nucleating agents such as those described above, the art has sought to synthesize improved nucleating agents which are more effective at lower concentrations. One approach toward finding such improved nucleating agents has been to synthesize heterocyclic nitrogen quaternary salts, such as disclosed by Kurtz and Harbison U.S. Pat. No. 3,734,738 issued May 22, 1973, and Kurtz and Heseltine U.S. Pat. No. 3,719,494 issued Mar. 6, 1973. Similarly, Lincoln and Heseltine U.S. Pat. Nos. 3,615,615 and 3,759,901 issued Apr. 13, 1970, and Sept. 18, 1973, teach the use of novel N-hydrazonoalkyl substituted heterocyclic nitrogen quaternary salts as nucleating agents. Another approach has been to synthesize sensitizing dyes that contain substitutents which have a nucleating capability, such as described by Spence and Janssen U.S. Pat. No. 3,718,470 issued Feb. 27, 1973.

The use in radiation-sensitive compositions and photographic elements of compounds containing heterocyclic thioamide nuclei is well known in the art. Such heterocyclic nuclei have been extensively employed in dyes to spectrally sensitize or desensitize silver halide emulsions. Fix and Jones U.S. Pat. No. 3,367,780 issued Feb. 6, 1968, for example, teaches employing a merocyanine spectral sensitizing dye which can contain a heterocyclic thioamide nucleus in a direct print emulsion containing a thiourea as a halogen acceptor. The term direct print, of course, refers to photographic elements which upon imagewise exposure to high intensity light followed by uniform low intensity light exposure form a negative silver image without further processing. Florens et al British Pat. No. 1,335,851 published Oct. 31, 1973, discoses direct-positive photographic application in which silver halide grains capable of forming internal latent image sites are surface fogged by using a conventional nucleating agent, such as hydrazine, thiourea dioxide, etc. and spectrally sensitized with a rhodanine merocyanine dye and a carbocyanine dye.

Belgian Pat. No. 819,853 discloses a thiourea substituted with a merocyanine or cationic cyanine nucleus. The resulting compound is disclosed to be useful as a supersensitizer which can be incorporated in the photographic element even under extreme conditions of storage without causing any increased tendency toward fogging, but this result is contrasted to results previously obtained in the art with other alkyl and aryl thioureas. (In considering these results it is important to realize that a fogging effect on storage in a photographic emulsion where no fogging is desired—e.g., in a negative-working emulsion—does not suggest the immediate and high levels of fogging required of nucleating agents under alkaline processing conditions.)

The present invention represents a significant advance in the search in the photographic arts for an improved class of nucleating agents and for improved radiation-sensitive compositions and photographic elements containing nucleating agents. Specifically, this invention is directed to an improved class of nucleating agents which can be effective at lower concentrations than have been employed heretofore in the art. If these improved nucleating agents are employed at higher concentration levels which overlap lower concentration levels suggested for the more effective among conventional nucleating agents, such as those discussed above, the improved nucleating agents of this invention are significantly more effective under comparable conditions of use. This invention has as its purpose to provide radiation-sensitive compositions and photographic elements which are useful in forming direct-positive images and which obviate physical defects due to nitrogen gas liberation. Further, this invention provides such elements and compositions by directly incorporating nucleating agents therein rather than in a developer composition. The improved nucleating agents of this invention can be present in these compositions and elements adsorbed to the surface of the silver halide grains. This invention further contemplates the use of combinations of nucleating agents. Finally, this invention has as one purpose to provide improved photographic elements of the dye image transfer type.

In one aspect this invention is directed to a radiation-sensitive composition comprising silver halide grains capable of forming an internal latent image when coated in photographic element and exposed to actinic radiation and, adsorbed to the surface of the silver halide grains, a heterocyclic N-(acylhydrazinophenyl)thioamide nucleating agent.

In another aspect this invention is directed to a photographic element comprised of a support and, as a coating thereon, a layer comprised of the above radiation-sensitive composition.

In still another aspect, this invention is directed to a dye image transfer photographic element comprised of a support, a layer coated thereon comprised of the above-described radiation-sensitive composition and a dye image receiver means.

In an additional aspect, this invention is directed to a heterocyclic N-(acylhydrazinophenyl)thioamide nucleating agent, and, more specifically, to a compound having the formula:

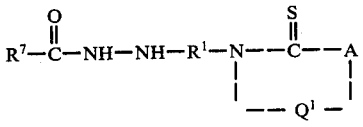

(I)

wherein:

$R^1$ is a phenylene group;

A is $=N-R^2$, —S— or —O—;

$Q^1$ represents the atoms necessary to complete a five-membered heterocyclic nucleus;

$R^2$ and $R^7$ are independently chosen from hydrogen, phenyl, alkyl, alkylphenyl and phenylalkyl; and the alkyl moieties in each instance include from 1 to 6 carbon atoms.

Our invention is directed then to certain novel heterocyclic N-(acylhydrazinophenyl)thioamide nucleating agents and to the use of heterocyclic N-(acylhydrazinophenyl)-thioamide nucleating agents in radiation-sensitive compositions and photographic elements. This invention is therefore to be distinguished from commonly assigned patent applications Ser. Nos. 601,888 and 601,891, both filed Aug. 6, 1975 titled PHOTOGRAPHIC NUCLEATING AGENTS OF THE HYDRAZINE TYPE and PHOTOGRAPHIC COMPOSITIONS AND ELEMENTS INCLUDING INTERNAL LATENT IMAGE SILVER HALIDE GRAINS AND NUCLEATING AGENTS, respectively, now abandoned in favor of continuation-in-part patent application Ser. No. 700,982 and 701,050, respectively, both filed June 29, 1976 and both issued June 21, 1977 as U.S. Pat. Nos. 4,031,127 and 4,030,925 respectively. These commonly assigned patent applications disclose acylhydrazinophenylthiourea nucleating agents, which possess properties not shared by the nucleating agents of this invention.

All formula symbols are employed consistently throughout this specification subject to explicitly stated qualifications. Accordingly, where a particular symbol recurs unaccompanied by further definition, the broadest definition presented elsewhere in the specification applies.

We contemplate the use of heterocyclic N-(acylhydrazinophenyl) thioamides as nucleating agents in radiation-sensitive compositions and photographic elements containing silver halide grains capable of forming an internal latent image. We have discovered that heterocyclic N-(acylhydrazinophenyl)thioamides can be readily adsorbed to the surface of silver halide grains and that they act as effective nucleating agents in exceedingly low concentrations when they are so adsorbed.

One specifically preferred, novel class of N-(acylhydrazinophenyl)thioamides useful in the practice of our invention are those identified above by formula (I). These compounds can be adsorbed to the surface of silver halide grains similarly as spectral sensitizing dyes. These compounds embrace those having a five-membered heterocyclic thioamide nucleus, such as a 4-thiazoline-2-thione, thiazolidine-2-thione, 4-oxazoline-2-thione, oxazolidine-2-thione, 2-pyrazoline-5-thione, pyrazolidine-5-thione, indoline-2-thione, 4-imidazoline-2-thione, etc. A specifically preferred sub-class of heterocyclic thioamide nuclei is formed when $Q^1$ is as indicated in formula (II)

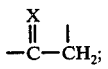

(II)

wherein:

X is =S or =O.

Specifically preferred illustrations of such values of $Q^1$ are 2-thiohydantoin, rhodanine, isorhodanine, and 2-thio-2,4-oxazolidinedione nuclei. It is believed that some six-membered nuclei, such as thiobarbituric acid, may be equivalent to five-membered nuclei embraced within formula (II).

Another specifically preferred sub-class of heterocyclic thioamide nuclei is formed when $Q^1$ is as indicated in formula (III)

$$-\overset{X}{\overset{\|}{C}}-\overset{|}{C}=(L-L=)_{n-1}T; \quad \text{(III)}$$

wherein:

L is a methine group;

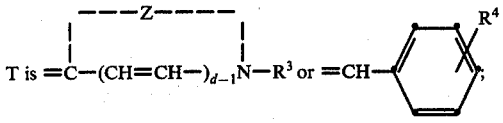

$R^3$ is an alkyl substituent;

$R^4$ is hydrogen; an alkyl,

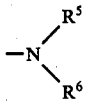

or an alkoxy substituent;

Z represents the nonmetallic atoms necessary to complete a basic heterocyclic nucleus of the type found in cyanine dyes;

*n* and *d* are independently chosen from the integers 1 and 2;

$R^5$ and $R^6$ are independently chosen from hydrogen, phenyl, alkyl, alkylphenyl and phenylalkyl; and the alkyl moieties in each instance include from 1 to 6 carbon atoms.

The formula (III) values for $Q^1$ provide a heterocyclic thioamide nucleus corresponding to a methine substituted form of the nuclei presented above in formula (II) values for $Q^1$. In a specifically preferred form the heterocyclic thioamide nucleus is preferably a methine substituted 2-thiohydantoin, rhodanine, isorhodanine, or 2-thio-2,4-oxazolidinedione nucleus. The heterocyclic thioamide nucleus of formula (III) is directly, or through an intermediate methine linkage, substituted with a basic heterocyclic nucleus of the type employed in cyanine dyes or a substituted benzylidene nucleus.

Basic heterocyclic nuclei of the type found in cyanine dyes typically take the form of 5- or 6-membered heterocyclic rings, wherein the ring-forming atoms are carbon, nitrogen, oxygen, sulfur and/or selenium. Exemplary of such cyanine dye nuclei are photographic sensitizing nuclei such as a heterocyclic nucleus of the thiazole series (e.g., thiazole, 4-methylthiazole, 5-methylthiazole, 4-phenylthiazole, 5-phenylthiazole, 4,5-dimethylthiazole, 4,5-diphenylthiazole, 4-(2-thienyl)thiazole, etc.), those of the benzothiazole series (e.g., benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 4-phenylbenzothiazole, 5-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, tetrahydrobenzothiazole, 5,6-dimethoxybenzothiazole, 5,6-methylenedioxybenzothiazole, 5-hydroxybenzothiazole, etc.), those of the naphthothiazole series (e.g., naphtho[2,1-d]thiazole, naphtho[1,2-d]thiazole, 5-methoxynaphtho[1,2-d]thiazole, 5-ethoxynaphtho[1,2-d]thiazole, 7-methoxynaphtho[2,1-d]thiazole, 8-methoxynaphtho[1,2-d]thiazole, etc.), those of the thieno[2,3-e]benzothiazole series (e.g., 4-methoxythieno[2,3-e]benzothiazole, etc.), those of the oxazole series (e.g., 4-methyloxazole, 5-methyloxazole, 4-phenyloxazole, 4,5-diphenyloxazole, 4-ethyloxazole, 4,5-dimethyloxazole, 5-phenyloxazole, etc.), those of the benzoxazole series (e.g., benzoxazole, 5-chlorobenzoxazole, 5-phenylbenzoxazole, 5-methylbenzoxazole, 6-methylbenzoxazole, 5,6-dimethylbenzoxazole, 4,6-dimethylbenzoxazole, 5-methoxybenzoxazole, 6-methoxybenzoxazole, 5-ethoxybenzoxazole, 6-chlorobenzoxazole, 5-hydroxybenzoxazole, 6-hydroxybenzoxazole, etc.), those of the naphthoxazole series (e.g., naphth[2,1-d]-oxazole, naphth[1,2-d]oxazole, etc.), those of the selenazole series (e.g., 4-methylselenazole, 4-phenylselenazole, etc.), those of the benzoselenazole series (e.g., benzoselenazole, 5-chlorobenzoselenazole, 5-methoxybenzoselenazole, 5-hydroxybenzoselenazole, tetrahydrobenzoselenazole, etc.), those of the naphthoselenazole series (e.g., naphtho[2,1-d]selenazole, naphtho[1,2-d]selenazole, etc.), those of the thiazoline series (e.g., thiazoline, 4-methylthiazoline, etc.), those of the quinoline series (e.g., 2-quinoline, 4-quinoline, 6-methoxyquinoline, 7-methylquinoline, 8-methylquinoline, 6-chloroquinoline, 8-chloroquinoline, 6-hydroxyquinoline, 8-hydroxyquinoline, etc.), those of the 1-isoquinoline series (e.g., isoquinoline, 3,4-dihydroisoquinoline, etc.), those of the 3,3-dialkyl-3H-indole series (e.g., 3,3-dimethyl-3H-indole, 3,3,5-trimethyl-3H-indole, 3,3,7-trimethyl-3H-indole, etc.), those of the pyridine series (e.g., 2-pyridine, 4-pyridine, 3-methylpyridine, 4-methylpyridine, 5-methylpyridine, 6-methylpyridine, 3,4-dimethylpyridine, 3,5-dimethylpyridine, 3,6-dimethylpyridine, 4,5-dimethylpyridine, 4,6-dimethylpyridine, 4-chloropyridine, 5-chloropyridine, 6-chloropyridine, 3-hydroxypyridine, 4-hydroxypyridine, 5-hydroxypyridine, 6-hydroxypyridine, 6-hydroxypyridine, 3-phenylpyridine, 4-phenylpyridine, 6-phenylpyridine, etc.), those of the 4-pyridine series (e.g., 2-methylpyridine, 3-methylpyridine, 2-chloropyridine, 3-chloropyridine, 2,3-dimethylpyridine, 2,5-dimethylpyridine, 2,6-dimethylpyridine, 2-hydroxypyridine, 3-hydroxypyridine, etc.), those of the imidazole series (e.g., imidazole, 4-methylimidazole, 5-ethylimidazole, 4-chloroimidazole, 4,5-dichloroimidazole, 4-methoxyimidazole, 5-phenylimidazole, etc.), those of the benzimidazole series (e.g., benzimidazole, 4-methylbenzimidazole, 5-methylbenzimidazole, 6-methylbenzimidazole, 5,6-dichlorobenzimidazole, 5-chlorobenzimidazole, 5-phenylbenzimidazole, 6-phenylbenzimidazole, etc.), and those of the naphthimidazole series (e.g., naphth[2,1-d]imidazole and naphth[1,2-d]imidazole, etc.).

In one preferred form the heterocyclic thioamide nucleus of formula (III) is substituted directly, or through the indicated methine linkage, with an unsubstituted benzylidene nucleus or a substituted benzylidene nucleus, such as an alkyl, alkoxy or amino-substituted benzylidene nucleus. The alkyl substituent can have from 1 to 6 carbon atoms and can take the form of a methyl, ethyl, n-propyl, isopropyl, n-butyl, isobutyl, tert-butyl, n-pentyl, neopentyl, n-hexyl or similar substituent. The alkyl moiety of the alkoxy substituent can be identical to the alkyl substituent. The amino substituent can be a primary, secondary, or tertiary amino substituent. The amino substituent can be unsubstituted, thereby forming a primary amino substituent. Alternatively, one or both hydrogen atoms can be displaced from the amino substituent with a phenyl, alkyl, phenylalkyl or alkylphenyl substituent, wherein each alkyl moiety present can be defined similarly as the alkyl substituent discussed above. It is recognized that higher molecular weight aromatic substituents may be generally equivalent to the preferred phenyl moieties. Where the heterocyclic thioamide nucleus is substituted with a benzylidene nucleus as described above, the compounds are absorptive to ultraviolet light and are herein referred to as benzylidene dyes. Where the amino group is located in the para position, the compounds absorb light also within the visible spectrum.

$R^1$ can be an ortho-, meta- or para-phenylene group. To minimize steric hindrance effects, it is preferred that $R^1$ be a meta- or para-phenylene group.

It is apparent that in the acyl group of the acylhydrazinophenylthioamides $R^7$ can be the residue of benzoic acid and an aliphatic carboxylic acid having up to about seven carbon atoms. It is preferred that $R^7$ take the form of an alkyl group having from 1 to 4 carbon atoms, such as methyl, ethyl, n-propyl, isopropyl, n-butyl, isobutyl and tert-butyl. In specifically preferred embodiments $R^7$ represents hydrogen, phenyl or methyl groups.

In the foregoing discussion of the novel nucleating agents of this invention, it is apparent that a variety of compound forms, some moieties of which are more preferred than others, can be employed in the practice of our invention. A specifically preferred compound class comprised of a combination of preferred moieties can be indicated by the formula:

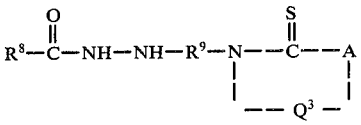

(IV)

wherein:

A is $=N-R^2$, $-S-$ or $-O-$;

$Q^3$ is represented by the formula

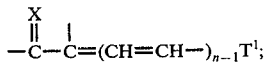

X is $=S$ or $=O$;

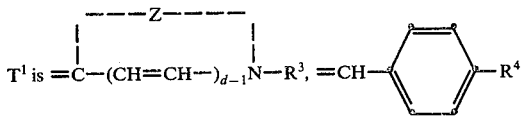

or $-H_2$;

$R^3$ is an alkyl substituent;

$R^4$ is hydrogen, an alkyl,

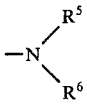

or an alkoxy substituent;

Z represents the nonmetallic atoms necessary to complete a basic 5- or 6-membered heterocyclic nucleus of the type found in cyanine dyes having ring-forming atoms chosen from the class consisting of carbon, nitrogen, oxygen, sulfur and selenium;

*n* and *d* are independently chosen from the integers 1 and 2;

$R^8$ is hydrogen, phenyl, methyl, ethyl, propyl or butyl;

$R^9$ is a meta- or para-phenylene group;

$R^2$, $R^5$ and $R^6$ are independently chosen from hydrogen, phenyl, alkyl, alkylphenyl and phenylalkyl; and the alkyl moieties in each instance include from 1 to 6 carbon atoms.

The synthesis of heterocyclic N-(acylhydrazinophenyl)thioamide nucleating agents useful in the practice of our invention is well within the skill of the art. For example, nucleating agents according to this invention can be prepared by the following procedure: Using as a known starting material 2-, 3- or 4-nitrophenylhydrazine, this compound can be reacted with a carboxylic acid or anhydride or halide thereof (e.g., benzoic anhydride, formic acid, acetic acid, hexanoyl chloride, acid, etc.) containing the desired acyl residue for the N-acylhydrazinophenyl thioamide. Where the carboxylic acid is a liquid, it can be used as a solvent for the reaction, an excess of the carboxylic acid is employed. In any instance a mutual solvent, such as benzene or acetonitrile, can be employed. Upon heating to reflux the nitrophenylhydrazide of the corresponding carboxylic acid precipitates from solution. The precipitate can then be dissolved in ethanol and reduced to the corresponding 1-acyl-2-(aminophenyl)hydrazine by hydrogenation at room temperature using a palladium catalyst.

Any one of the various specific compounds can then be synthesized using ring closure techniques well within the skill of the art. Illustrative techniques for closing a heterocyclic thioamide ring on an amino group such as that presented by the 1-acyl-2-(aminophenyl)hydrazine are disclosed, for example, in R. C. Elderfield, *Heterocyclic Compounds,* New York, John Wiley and Sons, 1957, Chapter 8, Volume 5.

Where the heterocyclic thioamide nucleus is a rhodanine nucleus, for example, the rhodanine nucleus can be formed according to the following procedure: After evaporating the ethanol, the 1-acyl-2-(aminophenyl)hydrazine is dissolved in an aqueous solution along with bis(carboxymethyl)trithiocarbonate and the pH is adjusted with sodium carbonate to a level less than 8, preferably in the range of from 3 to 4. The mixture is stirred and heated to a temperature of from 80° to 95° C and then chilled to obtain a compound of the type set forth in formula (I) as a precipitate wherein the heterocyclic N-thioamide nucleus is a rhodanine nucleus.

Where the heterocyclic thioamide nucleus is a 2-thiohydantoin nucleus, for example, an analogous reaction sequence is employed. The 1-acyl-2-(aminophenyl)hydrazine is converted to an isothiocyanate and then reacted with a glycine ester to form a heterocyclic N-(acylhydrazinophenyl)-2-thiohydantoin according to formula (I). To form the analogous 2-thio-2,4-oxazolidinedione compound the 1-acyl-2-(aminophenyl)hydrazine is dissolved in an aqueous solution along with carbamoylmethylthiothiocarbonyloxyacetic acid ($NH_2$—

$COCH_2S—C{=}SOCH_2COOH$) to precipitate a N-(acylhydrazinophenyl)-2-thio-2,4-oxazolidinedione. Specific procedures for producing 4-hydroxy-4-phenyl-thiazolidine-2-thione and 4-phenyl-4-thiazoline-2-thione nuclei in compounds of the type set forth in formula (II) values of $Q^1$ are set forth in the examples.

pounds according to the formula (III) values of $Q^1$ are set forth below as examples.

Illustrative specific heterocyclic N-(acylhydrazinophenyl)thioamide nucleating agents useful in the practice of this invention include those set forth below in Table I.

Table I

| | |
|---|---|
| NA-1 | 3-[4-(2-Formylhydrazino)phenyl]rhodanine |
| NA-2 | 1-Ethyl-3-[3-(2-formylhydrazino)phenyl]-2-thiohydantoin |
| NA-3 | 3-[4-(2-Acetylhydrazino)phenyl]rhodanine |
| NA-4 | 3-[4-(2-Acetylhydrazino)phenyl]-2-thio-2,4-oxazolidinedione |
| NA-5 | 3-[4-(2-Acetylhydrazino)phenyl]-4-hydroxy-4-phenylthiazolidine-2-thione |
| NA-6 | 3-[4-(2-Acetylhydrazino)phenyl]-4-phenyl-4-thiazoline-2-thione |
| NA-7 | 3-[3-(2-Butyrylhydrazino)phenyl]isorhodanine |
| NA-8 | 3-[4-(2-Hexanoylhydrazino)phenyl]-1-methyl-2-thiohydantoin |
| NA-9 | 3-[4-(2-Hexanoylhydrazino)phenyl]-2-thio-2,4-oxazolidinedione |
| NA-10 | 3-[4-(2-Benzoylhydrazino)phenyl]rhodanine |
| NA-11 | 3-[4-(2-Benzoylhydrazino)phenyl]-2-thiohydantoin |
| NA-12 | 3-[4-(2-o-Toluoylhydrazino)phenyl]-4-phenyl-4-thiazoline-2-thione |
| NA-13 | 3-{3-[2-(2,4-Dimethylbenoyl)hydrozino]phenyl}rhodanine |
| NA-14 | 3-{4-[2-(2,4-Dimethylbenzoyl)hydrazino]phenyl}-2-thiohydantoin |
| NA-15 | 3-{4-[2-(4-Ethylbenzoyl)hydrazino]phenyl}thiazole |
| NA-16 | 5-(3-Ethyl-2-benzothiazolinylidene)-3-[4-(2-formylhydrazino)phenyl]rhodanine |
| NA-17 | 3-{3-(2-Formylhydrazino)phenyl}rhodanine |
| NA-18 | 5-(3-Ethyl-2-benzothiazolinylidene)-3-{3-(2-formylhydrazino)phenyl}rhodanine |
| NA-19 | 3-[4-(2-Formylhydrazino)phenyl]-5-(3-methyl-2-benzothiazolinylidene)-2-thio-2,4-oxazolidinedione |
| NA-20 | 3-[4-(2-Formylhydrazino)phenyl]-5-[3-(3-sulfopropyl)-2-benzothiazolinylidene]-rhodanine triethylamine salt |
| NA-21 | 3-[4-(2-Acetylhydrazino)phenyl]-5-[3-(3-sulfopropyl)-2-benzothiazolinylidene]-rhodanine triethylamine salt |
| NA-22 | 3-[4-(2-Acetylhydrazino)phenyl-1-methyl-5-(3-ethyl-2-benzoxazolinylidene)-2-thiohydantoin |
| NA-23 | 3-[4-(2-Benzoylhydrazino)phenyl]-5-(3-methyl-2-benzoxazolinylidene)rhodanine |
| NA-24 | 5-(3-Ethyl-2-benzoxazolinylidene)-3-[4-(2-benzoylhydrazino)phenyl]-2-thio-2,4-oxazolidinedione |
| NA-25 | 3-[4-(2-Formylhydrazino)phenyl]-5-(3-methyl-2-benzoxazolinylidene)-4-phenyl-4-thiazolidine-2-thione |
| NA-26 | 3-[4-(2-Formylhydrazino)phenyl]-5-(3-methyl-2-benzoxazolinylidene)rhodanine |
| NA-27 | 3-[4-(2-Acetylhydrazino)phenyl]-5-(3-methyl-2-benzoxazolinylidene)rhodanine |
| NA-28 | 3-[3-(2-Acetylhydrazino)phenyl]-5-(3-methyl-2-benzoxazolinylidene)-1-phenyl-2-thiohydantoin |
| NA-29 | 5-[3-Ethyl-2-benzoxazolinylidene)ethylidene]-3-[4-(2-formylhydrazino)phenyl]-rhodanine |
| NA-30 | 3-[4-(2-Acetylhydrazino)phenyl]-5-[(3-ethyl-2-benzoxazolinylidene)ethylidene]rhodanine |
| NA-31 | 3-[4-(2-Benzoylhydrazino)phenyl]-5-[(3-ethyl-2-benzoxazolinylidene)ethylidene]rhodanine |
| NA-32 | 5-[(3-Ethyl-2-benzothiazolinylidene)ethylidene]-3-[4-(2-formylhydrazino)phenyl]rhodanine |
| NA-33 | 3-[4-(2-Acetylhydrazino)phenyl]-5-[(3-ethyl-2-benzothiazolinylidene)ethylidene]rhodanine |
| NA-34 | 3-[4-(2-Benzoylhydrazino)phenyl]-5-[(3-ethyl-2-benzothiazolinylidene)ethylidene]rhodanine |
| NA-35 | 3-[4-(2-Benzoylhydrazino)phenyl]-5-(3-ethyl-2-benzothiazolinylidene]rhodanine |
| NA-36 | 3-[4-(2-Formylhydrazino)phenyl]-5-(4-methyl-benzylidene)rhodanine |
| NA-37 | 3-[3-(2-Acetylhydrazino)phenyl]-5-(4-aminobenzylidene)rhodanine |
| NA-38 | 3-[4-(2-Benzoylhydrazino)phenyl]-5-(4-butylbenzylidene)-4-thiazoline-2-thione |
| NA-39 | 5-(4-Hexylbenzylidene)-3-[4-(2-formylhydrazinophenyl]-1-methyl-2-thiohydantoin |
| NA-40 | 3-[4-(2-Formylhydrazino)phenyl]-5-(4-methoxybenzylidene)rhodanine |
| NA-41 | 5-(4-Butoxybenzylidene)-3-[4-(2-formylhydrazino)phenyl]rhodanine |
| NA-42 | 3-[4-(2-Acetylhydrazino)phenyl]-5-(4-methylbenzylidene)rhodanine |
| NA-43 | 3-[4-(2-Acetylhydrazino)phenyl]-5-(4-methoxybenzylidene)rhodanine |
| NA-44 | 5-(4-N,N-Dimethylaminobenzylidene)-3-[4-(2-formylhydrazino)phenyl]rhodanine |
| NA-45 | 3-[4-(2-Formylhydrazino)phenyl]-5-(4-N-phenylaminobenzylidene)-2-thiohydantoin |

To form the compounds of formula (III) values of $Q^1$ the corresponding heterocyclic N-(acylhydrazinophenyl)thioamide of formula (II) is substituted with a basic nucleus of the type found in cyanine dyes or with a benzylidine nucleus. The benzylidene or basic heterocyclic nucleus can be a direct substituent or can be linked to the heterocyclic thioamide nucleus through an intermediate methine linkage. For example, a compound of the type shown in formula (I) having a heterocyclic thioamide nucleus corresponding to that required in the formula (II) value of $Q^1$ can be substituted with a benzylidene nucleus merely by reacting the compound with a benzaldehyde or a cinnamaldehyde. The heterocyclic thioamide nucleus can be substituted alternatively with a basic heterocyclic nucleus of the type found in cyanine dyes following conventional techniques, such as those disclosed in Brooker et al, J. American Chemical Society, 73, 5326 (1951) and in F. M. Hamer, *Cyanine Dyes and Related Compounds,* New York, Interscience, 1964, Chapter XIV. Specific illustrative techniques for synthesizing preferred com- The heterocyclic N-(acylhydrazinophenyl)thioamide nucleating agents can be employed with any conventional photographic element capable of forming a direct-positive image containing at least one radiation-sensitive layer containing silver halide grains capable of forming an internal latent image upon exposure to actinic radiation. As employed herein, the terms "internal latent image silver halide grains" and "silver halide grains capable of forming an internal latent image" are employed in the art-recognized sense of designating silver halide grains which produce substantially higher optical densities when coated, imagewise exposed and developed in an internal developer than when comparably coated, exposed and developed in a surface developer. Preferred internal latent image silver halide grains are those which when examined according to to normal photographic testing techniques, by coating a test portion on a photographic support at a density of from 3 to 4 grams/$m^2$, exposing to a light intensity scale for a fixed time between $1 \times 10^{-2}$ (such as, for example, with a 500 watt tungsten lamp at a distance of 61 cm) and 1 second and developing for 5 minutes at 25° C in Kodak Developer DK-50 (a surface developer) provide a density of at least 0.5 density units less than when this testing procedure is repeated substituting for the surface developer Kodak Developer DK-50 containing 0.5 gram per liter of potassium iodide (an internal developer). The internal latent image silver halide grains most preferred for use in the practice of this invention are those which when tested using an internal developer and a surface developer as indicated above produce an optical density with the internal developer at least 5 times that produced by the surface developer. It is additionally preferred that the internal latent image silver halide grains produce an optical density of less than 0.4 and, most preferably, less than 0.25 when coated, exposed and developed in surface developer as indicated above—that is, the silver halide grains are initially substantially unfogged and free of latent image on their surface.

The surface developer referred to herein as Kodak Developer DK-50 is described in the *Handbook of Chemistry and Physics,* 30th ed., 1947, Chemical Rubber Publishing Co., Cleveland, Ohio, p. 2558, and has the following composition:

| | |
|---|---|
| Water, about 125° F (52° C) | 500.0 cc |
| N-methyl-p-aminophenol sulfate | 2.5 g |
| Sodium sulfite, desiccated | 30.0 g |
| Hydroquinone | 2.5 g |
| Sodium metaborate | 10.0 g |
| Potassium bromide | 0.5 g |
| Water to make | 1.0 liter. |

Internal latent image silver halide grains which can be employed in the practice of this invetion are well known in the art. Patents teaching the use of internal latent image silver halide grains in photographic emulsions and elements include Davey et al U.S. Pat. No. 2,592,250, issued May 8, 1952; Porter et al U.S. Pat. No. 3,206,313, issued Sept. 14, 1965; Milton U.S. Pat. No. 3,761,266, issued Sept. 25, 1973; Ridgway U.S. Pat. No. 3,586,505, issued June 22, 1971; Gilman et al U.S. Pat. No. 3,772,030, issued Nov. 13, 1973; Gilman et al U.S. Pat. No. 3,761,267, issued Sept. 25, 1973; and Evans U.S. Pat. No. 3,761,276, issued Sept. 25, 1973, the disclosures of which are here incorporated by reference.

The internal latent image silver halide grains preferably contain bromide as the predominant halide. The silver bromide grains can consist essentially of silver bromide or can contain silver bromoiodide, silver chlorobromide, silver chlorobromoiodide crystals and mixtures thereof. Internal latent image forming sites can be incorporated into the grains by either physical or chemical internal sensitization. Davey et al, cited above, for example, teaches the physical formation of internal latent image forming sites by the halaide conversion technique. Chemical formation of internal latent image forming sites can be produced through the use of sulfur, gold, selenium, tellurium and/or reduction sensitizers of the type described, for example, in Sheppard et al U.S. Pat. No. 1,623,499, issued Apr. 5, 1927; Waller et al U.S. Pat. No. 2,399,083, issued Apr. 23, 1946; McVeigh U.S. Pat. No. 3,297,447, issued January 10, 1967 and Dunn U.S. Pat. No. 3,297,446, issued Jan. 10, 1967, as taught in the patents cited in the preceding paragraph. Internal latent image sites can also be formed through the incorporation of metal dopants, particularly Group VIII platinum metals such as ruthenium, rhodium, palladium, iridium, osmium and platinum, as taught by Berriman U.S. Pat. No. 3,367,778, issued Feb. 6, 1968 and by Evans, cited above. The preferred foreign metal ions are polyvalent metal ions which include the above-noted Group VIII dopants as well as polyvalent metal ions such as lead, antimony, bismuth, arsenic and the like. In highly preferred embodiments, the silver halide grains are formed in the presence of bismuth, lead or iridium ions. In a preferred approach the internal latent image sites can be formed within the silver halide grains during precipitation of silver halide. In an alternate approach a core grain can be formed which is treated to form the internal latent image sites and then a shell deposited over the core grains, as taught by Porter et al, cited above.

The silver halide grains employed in the practice of this invention are preferably monodispersed, and in some embodiments are preferably large-grain emulsions made according to Wilgus, Germn OLS No. 2,107,118, published Sept. 2, 1971, which is incorporated herein by reference. The monodispersed emulsions are those which comprise silver halide grains having a substantially uniform diameter. Generally, in such emulsions, no more than about 5 percent, by weight, of the silver halide grains smaller than the mean grain size and/or no more than about 5 percent, by number, of the silver halide grains larger than the mean grain size vary in diameter from the mean grain diameter by more than about 40 percent. Preferred photographic emulsions of this invention comprise silver halide grains, at least 95 percent, by weight, of said grains having a diameter which is within 40 percent, preferably within about 30 percent, of the mean grain diameter. Mean gain diameter, i.e., average grain size, can be determined using conventional methods, e.g., such as projective area as shown in an article by Trivelli and Smith entitled "Empirical Relations between Sensitometric and Size-Frequency Characteristics in Photographic Emulsion Series" in *The Photographic Journal,* Vol. LXXIX, 1939, pp. 330–338. The aforementioned uniform size distribution of silver halide grains is a characteristic of the grains in monodispersed photographic silver halide emulsions. Silver halide grains having a narrow size distribution can be obtained by controlling the conditions at which the silver halide grains are prepared using a double-run procedure. In such a procedure, the silver halide grains are prepared by simultaneously running an aqueous solution of a silver salt, such as silver nitrate, and an aqueous solution of a water-soluble halide, for example, an alkali metal halide such as potassium bromide, into a rapidly agitated aqueous solution of a silver halide peptizer, preferably gelatin, a gelatin derivative or some other protein peptizer. The pH and the pAg employed in this type of procedure are interrelated. For example, changing one which maintaining the other constant at a given temperature can change the size frequency distribution of the silver halide grains which are formed. However, generally the temperature is about 30° to about 90° C, the pH is up to about 9, preferably 4 or less, and the pAg is up to about 9.8. Suitable methods for preparing photographic silver halide emulsions having the required uniform particle size are disclosed in an article entitled "Ia: Properties of Photographic Emulsion Grains", by Klein and Moisar, *The Journal of Photographic Science,* Vol. 12, 1964, pp. 242–251; an article entitled "The Spectral Sensitization of Silver Bromide Emulsions on Different Crystallographic Faces", by Markocki, *The Journal of Photo-*

*graphic Science,* Vol. 13, 1965, pp. 85–89; an article entitled "Studies on Silver Bromide Sols, Part I. The Formation and Aging of Monodispersed Silver Bromide Sols", by Ottewill and Woodbridge, *The Journal of Photographic Science,* Vol. 13, 1965, pp. 98–103; and an article entitled "Studies on Silver Bromide Sols, Part II. The Effect of Additives on the Sol Particles", by Ottewill and Woodbridge, *The Journal of Photographic Science,* Vol. 13, 1965, pp. 104–107.

Where internal latent image sites have been formed through internal chemical sensitization or the use of metal dopants, the surface of the silver halide grains can be below that which will produce substantial density in a surface developer—that is, less than 0.4 when coated, exposed and surface developed as described above. The silver halide grains are preferably predominantly silver bromide grains chemically surface sensitized to a level which would provide a maximum density of at least 0.5 using undoped silver halide grains of the same size and halide composition when coated, exposed and developed as described above.

Surface chemical sensitization can be undertaken using techniques such as those disclosed by Sheppard, Waller et al, McVeigh or Dunn, cited above. The silver halide grains can also be surface sensitized with salts of the noble metals, such as ruthenium, palladium and platinum. Representative compounds are ammonium chloropalladate, potassium chloroplatinate and sodium chloropalladite, which are used for sensitizing in amounts below that which produces any substantial fog inhibition, as described in Smith and Trivelli U.S. Pat. No. 2,448,060, issued Aug. 31, 1948, and as antifoggants in higher amounts, as described in Trivelli and Smith U.S. Pat. No. 2,566,245 issued Aug. 28, 1951 and U.S. Pat. No. 2,566,263, issued Aug. 28, 1951. The silver halide grains can also be chemically sensitized with reducing agents, such as stannous salts (Carroll U.S. Pat. No. 2,487,850, issued Nov. 15, 1949), polyamines, such as diethylene triamine (Lowe et al U.S. Pat. No. 2,518,698, issued Aug. 15, 1950), polyamines, such as spermine (Lowe et al U.S. Pat. No. 2,521,925, issued Sept. 12, 1950), or bis($\beta$-aminoethyl)sulfide and its water-soluble salts (Lowe et al U.S. Pat. No. 2,521,926, issued Sept. 12, 1950).

The internal latent image silver halide grains can be optically sensitized using conventional techniques. For instance, spectral sensitization can be obtained by treating the silver halide grains with a solution of a sensitizing dye in an organic solvent or the dye may be added in the form of a dispersion as described in Owens et al British Pat. No. 1,154,781 published June 11, 1969.

Sensitizing dyes useful in sensitizing silver halide emulsions are described, for example, in Brooker et al U.S. Pat. No. 2,526,632, issued Oct. 24, 1950; Sprague U.S. Pat. No. 2,503,776, issued Apr. 11, 1950; Brooker et al U.S. Pat. No. 2,493,748, issued Jan. 10, 1950; and Taber et al U.S. Pat. No. 3,384,486, issued May 21, 1968. Spectral sensitizers which can be used include the cyanines, merocyanines, complex (tri- or tetranuclear) cyanines, holopolar cyanines, styryls, hemicyanines (e.g., enamine hemicyanines) oxonols and hemioxonols.

Preferred optical sensitizers include cyanine and merocyanine dyes, such as those described in U.S. Pat. Nos. 1,846,301 and 1,846,302, both issued Feb. 23, 1932, and U.S. Pat. No. 1,942,854, issued Jan. 9. 1934, all by Brooker; U.S. Pat. No. 1,990,507 by White, issued Feb. 12, 1935; U.S. Pat. No. 2,112,140, issued Mar. 22, 1938; U.S. Pat. No. 2,165,338, issued July 11, 1939, U.S. Pat. No. 2,493,747, issued Jan. 10, 1950, and U.S. Pat. No. 2,739,964, issued Mar. 27, 1956, all by Brooker et al; U.S. Pat. No. 2,493,748 by Brooker et al, issued Jan. 10, 1950; U.S. Pat. No. 2,503,776, cited above; and U.S. Pat. No. 2,519,001, issued Aug. 15, 1950, both by Sprague; U.S. Pat. No. 2,666,761 By Heseltine et al, issued Jan. 19, 1954; U.S. Pat. No. 2,734,900, by Heseltine, issued Feb. 14, 1956; and U.S. Pat. No. 2,739,149 by Van Lare issued Mar. 20, 1956; and Kodak Limited British Pat. No. 450,958 accepted July 15, 1936.

To obtain the benefits of this invention, the internal latent image silver halide grains and a heterocyclic N-(acylhydrazinophenyl)thioamide nucleating agents are brought together in a radiation-sensitive layer of a photographic element. In a preferred form of the invention, the silver halide grains and the heterocyclic N-(acylhydrazinophenyl)thioamide nucleating agent are incorporated in a radiation-sensitive silver halide emulsion of a type employed in photography. Techniques for forming photographic silver halide emulsions are generally well known to those skilled in the art. Techniques for forming and washing silver halide emulsions are generally taught in *Product Licensing Index,* Vol. 92, December 1971, publication 9232, paragraphs I and II.

The photographic emulsions and elements described in the practice of this invention can contain various colloids alone or in combination as vehicles, as binding agents and as various layers. Suitable hydrophilic materials include both naturally occurring substances such as proteins, for example, gelatin, gelatin derivatives, cellulose derivatives, polysaccharides such as dextran, gum arabic and the like; and synthetic polymeric substances such as water-soluble polyvinyl compounds like poly(-vinylpyrrolidone), acrylamide polymers and the like.

The described photographic emulsion layers and other layers of a photographic element employed in the practice of this invention can also contain, alone or in combination with hydrophilic, water-permeable colloids, other synthetic polymeric compounds such as dispersed vinyl compounds such as in latex form and particularly those which increase the dimensional stability of the photographic materials. Suitable synthetic polymers include those described, for example, in U.S. Pat. No. 3,142,568 by Nottorf, issued July 28, 1964; U.S. Pat. No. 3,193,386 by White, issued July 6, 1965; U.S. Pat. No. 3,062,674 by Houck et al, issued Nov. 6, 1962; U.S. Pat. No. 3,220,844 by Houck et al, issued Nov. 30, 1965; U.S. Pat. No. 3,287,289 by Ream et al, issued Nov. 22, 1966; and U.S. Pat. No. 3,411,911 by Dykstra, issued Nov. 19, 1968; particularly effective are those water-insoluble polymers or latex copolymers of alkyl acrylates and methacrylates, acrylic acid, sulfoalkyl acrylates or methacrylates, those which have cross-linking sites which facilitate hardening or curing, those having recurring sulfobetaine units as described in Canadian Pat. No. 774,054 by Dykstra, and those described in U.S. Pat. No. 3,488,708 by Smith, issued Jan. 6, 1970.

The photographic emulsion layers can contain a variety of conventional photographic addenda. For example, hardeners of the the type disclosed in *Product Licensing Index,* cited above, paragraph VII, can be employed. Similarly plasticizers, lubricants and coating aids of the type disclosed in *Product Licensing Index,* cited above, paragraphs XI and XII, can be employed.

The heterocyclic N-(acylhydrazinophenyl)thioamide nucleating agents of this invention can be employed in any desired concentration that will permit a degree of selectivity in developing imagewise silver halide grains capable of forming an internal latent image, which grains have not been imagewise exposed, as compared to silver halide grains containing an internal latent image formed by imagewise exposure.

In a preferred form of this invention heterocyclic N-(acylhydrazinophenyl)thioamide nucleating agents are adsorbed to the surface of the internal latent image silver halide grains and employed in concentrations ranging from 0.1 to 50 mg of adsorbed nucleating agent per mole of silver. Preferably 0.5 to 25 mg of adsorbed nucleating agent per mole of silver is employed and, most preferably, 1 to 15 mg of adsorbed nucleating agent per mole of silver. Optimum concentrations can, of course, vary somewhat from one application to another. Where the heterocyclic N-(acylhydrazinophenyl)thioamide nucleating agent is to be adsorbed to the surface of the silver halide grains, it can be adsorbed using the procedures well known to those skilled in the art for adsorbing cyanine sensitizing dyes. Where the heterocyclic N-(acylhydrazinophenyl)thioamide is in the form of a cyanine sensitizing dye and adsorbed to the surface of the silver halide grains, it may be relied upon to spectrally sensitize the silver halide grains. However, use of the heterocyclic N-(acylhydrazinophenyl)thioamides in quantities sufficient to spectrally sensitize the silver halide grains is not required, since other spectral sensitizers can be employed for this purpose and since the lower concentrations employed for nucleating may be below those desired for spectral sensitization.

It is specifically contemplated to employ in combination with heterocyclic N-(acylhydrazinophenyl)thioamide nucleating agents other conventional nucleating agents. In a specifically preferred form one or a combination of heterocyclic N-(acylhydrazinophenyl)thioamide nucleating agents are employed at a concentration of up to about 50 mg per mole of silver, as indicated above, in combination with a conventional substituted hydrazine type nucleating agent which is present in a concentration of from about 200 mg to about 2 grams per mole of silver.

One or a combination of the present heterocyclic N-(acylhydrazinophenyl)thioamide nucleating agents can be employed in combination with an acylhydrazinophenylthiourea nucleating agent as described in the aforementioned concurrently filed, commonly assigned patent applications Ser. Nos. 601,888 and 601,891, cited above.

The heterocyclic N-(acylhyrazinophenyl)thioamide nucleating agents can be employed in combination with hydrazide and hydrazone nucleating agents of the type disclosed by Whitmore, cited above. Such hydrazides and hydrazones are nitrogen-containing compounds having the formulas $$T^2NH—NH—T^3$$

and $$T^2—NH—N{=}T^4$$

wherein $T^2$ is an aryl radical and including substituted aryl radical $T^3$ is an acyl or a sulfonyl radical; and $T^4$ is an alkylidene radical and including substituted alkylidene radicals. Typical aryl radicals for the substituent $T^2$ have the formula M-$T^5$—wherein $T^5$ is an aryl radical (such as phenyl, 1-naphthyl, 2-naphthyl, etc.) and M can be such substituents as hydrogen, hydroxy, amino, alkyl, alkylamino, arylamino, heterocyclic amino (amino containing a heterocyclic moiety), alkoxy, aryloxy, acyloxy, arylcarbonamido, alkylcarbonamido, heterocyclic carbonamido (carbonamido containing a heterocyclic moiety), arylsulfonamido, alkylsulfonamido, and heterocyclic sulfonamido (sulfonamido containing a heterocyclic moiety). Typical acyl and sulfonyl radicals for the substituent $T^3$ have the formula $$-\overset{\overset{O}{\|}}{\underset{\underset{O}{\|}}{S}}-Y \text{ or } -\overset{\overset{O}{\|}}{C}-G$$

wherein Y can be such substituents as alkyl, aryl and heterocyclic radicals. G can represent a hydrogen atom or the same substituents as Y as well as radicals having the formula $$-\overset{\overset{O}{\|}}{C}-O-E$$

to form oxalyl radicals wherein E is an alkyl, aryl or a heterocyclic radical. Typical alkylidene radicals for the substituent $T^4$ have the formula $=C—D_2$ wherein D can be a hydrogen atom or such radicals as alkyl, aryl and heterocyclic radicals. Typical aryl substituents for the above-described hydrazides and hydrazones include phenyl, naphthyl, diphenyl, and the like. Typical heterocyclic substituents for the above-described hydrazides and hydrazones include azoles, azines, furan, thiophene, quinoline, pyrazole, and the like. Typical alkyl (or alkylene) substituents for the above-described hydrazides and hydrazones have 1 to 22 carbon atoms including methyl, ethyl, isopropyl, n-propyl, isobutyl, n-butyl, t-butyl, amyl, n-octyl, n-decyl, n-dodecyl, n-octadecyl, n-eicosyl, n-docosyl, etc.

In another form of this invention the acylhydrazino substituted rhodanine nucleating agents are employed in combination with N-substituted cycloammonium quaternary salts of the type disclosed by Kurtz, Harbison, Heseltine and Lincoln, cited above. Generally these compounds can be represented by the formula:

$$\begin{array}{l} \text{-----}Z^1\text{-----} \\ \quad | \qquad\qquad\qquad\qquad | \\ \quad N^{\oplus}{=}(CH{-}CH)_{j-1}{=}C{-}E^1 \\ \quad | \\ X^{\ominus}\ (CH_2)_a \\ \quad | \\ \quad E^2 \end{array}$$

wherein:

(1) $Z^1$ represents the atoms necessary to complete a heterocyclic nucleus containing a heterocyclic ring of 5 to 6 atoms including the quaternary nitrogen atom, with the additional atoms of said heterocyclic ring being selected from carbon, nitrogen, oxygen, sulfur and selenium;

(2) *j* represents a positive integer of from 1 to 2;

(3) *a* represents a positive integer of from 2 to 6;

(4) $X^-$ represents an acid anion;

(5) $E^2$ represents a member selected from:

(a) a formyl radical, (b) a radical having the formula:

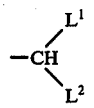

wherein each of $L^1$ and $L^2$, when taken alone, represents a member selected from an alkoxy radical and an alkylthio radical, and $L^1$ and $L^2$, when taken together, represent the atoms necessary to complete a cyclic radical selected from cyclic oxyacetals and cyclic thioacetals having from 5 to 6 atoms in the heterocyclic acetal ring, and (c) a 1-hydrazonoalkyl radical; and (6) $E^1$ represents either a hydrogen atom, an alkyl radical, an aralkyl radical, an alkylthio radical or an aryl radical such as phenyl and naphthyl, and including substituted aryl radicals.

In certain embodiments of this invention, the N-substituted, cycloammonium quaternary salts are those which contain N-substituted alkyl radicals having the terminal carbon atom substituted with a hydrazono radical, an acyl radical such as a formyl radical, an acetyl radical or a benzoyl radical, and those which have a dihydro—aromatic ring nucleus such as, for example, a dihydropyridinium nucleus.

To form a photographic element according to the present invention it is merely necessary to coat onto a conventional photographic support a radiation-sensitive composition comprised of internal latent image silver halide grains and a heterocyclic N-(acylhydrazinophenyl) thioamide nucleating agent. Conventional photographic supports, including film and paper photographic supports, are disclosed in *Product Licensing Index,* cited above, paragraph X.

A simple exposure and development process can be used to form a direct-positive image. In one embodiment, a photographic element comprising at least one layer of a silver halide composition as described above can be imagewise exposed and then developed in a silver halide surface developer.

It is understood that the term "surface developer" encompasses those developers which will reveal the surface latent image on a silver halide grain, but will not reveal substantial internal latent image in an internal image-forming emulsion, and under the conditions generally used develop a surface-sensitive silver halide emulsion. The surface developers can generally utilize any of the silver halide developing agents or reducing agents, but the developing bath or composition is generally substantially free of a silver halide solvent (such as water-soluble thiocyanates, water-soluble thioethers, thiosulfates, ammonia and the like) which will crack or dissolve the grain to reveal substantial internal image. Low amounts of excess halide are sometimes desirable in the developer or incorporated in the emulsion as halide-releasing compounds, but high amounts of iodide or iodide-releasing compounds are generally avoided to prevent substantial cracking of the grain.

Typical silver halide developing agents which can be used in the developing compositions of this invention include hydroquinones, catechols, aminophenols, 3-pyrazolidones, ascorbic acid and its derivatives, reductones, phenylenediamines and the like or combinations thereof. The developing agents can be incorporated in the photographic elements wherein they are brought in contact with the silver halide after imagewise exposure; however, in certain embodiments they are preferably employed in the developing bath.

The developing compositions used in the process of this invention can also contain certain antifoggants and development restrainers, or optionally they can be incorporated in layers of the photographic element. For example, in some applications improved results can be obtained when the direct-positive emulsions are processed in the presence of certain antifoggants as disclosed in U.S. Pat. No. 2,497,917, which is incorporated herein by reference.

Typical useful antifoggants include benzotriazoles, such as benzotriazole, 5-methylbenzotriazole, 5-ethylbenzotriazole and the like, benzimidazoles such as 5-nitrobenzimidazole, and the like, benzothiazoles such as 5-nitrobenzothiazole, 5-methylbenzothiazole and the like, heterocyclic thiones such as 1-methyl-2-tetrazoline-5-thione and the like, triazines such as 2,4-dimethylamino-6-chloro-5-triazine and the like, benzoxazoles such as ethylbenzoxazole and the like, and pyrroles such as 2,5-dimethylpyrrole and the like.

In certain embodiments, good results are obtained when the elements are processed in the presence of high levels of the antifoggants mentioned above. When antifoggants such as benzotriazoles are used, good results can be obtained when the processing solution contains up to 5 g/l and preferably 1 to 3 g/l; when they are incorporated in the photographic element, concentrations of up to 1000 mg/mole of Ag and preferably concentrations of 100 to 500 mg/mole of Ag are employed.

It is, of course, known in the art that nucleating agents can be incorporated into surface developers in forming direct-positive images. While the heterocyclic N-(acylhydrazinophenyl)thioamide nucleating agents could conceivably be incorporated into surface developers, it is our view that superior results are obtainable by incorporating the heterocyclic N-(acylhydrazinophenyl)thioamide nucleating agents in the photographic element prior to development. It is, however, recognized that the other conventional nucleating agents discussed above for use in combination with the heterocyclic N-(acylhydrazinophenylthioamide nucleating agents could be incorporated in the surface developer, wholly or partially, rather than being incorporated in the photographic element. It is preferred that the nucleating agents be entirely incorporated in the photographic element as opposed to the surface developer in most applications.

This invention may be used with elements designed for color photography, for example, elements containing color-forming couplers such as those described in U.S. Pat. No. 2,376,679 by Frohlich et al, U.S. Pat. No. 2,322,027 by Jelley et al, U.S. Pat. No. 2,801,171 by Fierke et al, U.S. Pat. No. 2,698,794 by Godowsky, U.S. Pat. No. 3,227,554 by Barr et al and U.S. Pat. No. 3,046,129 by Graham et al; or elements to be developed in solutions containing color-forming couplers such as those described in U.S. Pat. No. 2,252,718 by Mannes et al, U.S. Pat. No. 2,592,243 by Carroll et al and U.S. Pat. No. 2,950,970 by Schwan et al; and in false-sensitized color materials such as those described in U.S. Pat. No. 2,763,549 by Hanson.

This invention is useful with photographic elements used in image transfer processes or in image transfer film units. Generally the invention can be used with the color image transfer processes and the film units as described in Whitmore U.S. Pat. Nos. 3,227,550 and 3,227,552 issued Jan. 4, 1966; U.S. Pat. No. 2,983,606;

U.S. Pat. No. 2,543,181; Whitmore Canadian Pat. No. 674,082; Belgian Pat. Nos. 757,959 and 757,960 both issued Apr. 23, 1971, and the like.

The silver halide emulsions as described herein are particularly useful in combination with negative working image dye providing materials, i.e., those materials which produce a negative pattern of transferred image dye when used in combination with a negative-working silver halide emulsion. Typical useful negative-working image dye providing materials are disclosed in Fleckenstein, U.S. Patent application Ser. No. 351,673, published Jan. 28, 1975 as Trial Voluntary Protest No. B351,673; U.S. Pat. No. 3,698,897, issued Oct. 17, 1972, of Gompf and Lum; U.S. Pat. No. 3,728,113, issued Apr. 17, 1973, of Becker et al; U.s. Pat. No. 3,725,062, issued Apr. 3, 1973, of Anderson and Lum; U.S. Pat. No. 3,148,062, issued Sept. 8, 1964, of Whitmore et al; U.S. Pat. Nos. 3,628,952 and 3,844,785; and German OLS No. 2,317,134.

The direct positive silver halide emulsions of this invention are preferably used in combination with negative-working dye providing materials because the combination produces a positive transfer image. However, it is recognized that the direct positive emulsions can also be used with positive-working image dye providing materials such as dye developers as disclosed in U.S. Pat. No. 2,983,606, oxichromic developers as disclosed in U.S. Pat. No. 3,880,658, shifted dye developers as disclosed in Hinshaw U.S. Ser. No. 534,966, filed Dec. 20, 1975, and the like. Positive images are obtained in the exposed silver halide emulsion layers while a transferred negative image is obtained where the direct positive emulsions are used in combination with negative-working image dye providing materials. Also, where the exposure is made of a negative image or through a negative image record, positive transfer images are obtained with the combination of direct positive emulsions and positive-working image dye providing materials.

Generally, the image-transfer film units in accordance with this invention comprise:

(1) a photosensitive element comprising support having thereon at least one layer containing a radiation-sensitive internal latent image silver halide and a heterocyclic N-(acylhydrazinophenyl)thioamide nucleating agent containing a layer as described above, preferably having associated therewith an image dye-providing material;

(2) an image-receiving layer which can be located on a separate support and superposed or adapted to be superposed on said photosensitive element, or preferably can be coated as a layer in the photosensitive element, and (3) means containing an alkaline processing composition adapted to discharge its contents within said film unit and wherein said film unit contains a silver halide developing agent so that the processing composition and developing agent when brought together form a silver halide surface developer.

In highly preferred embodiments, the film units of this invention contain a support having thereon a layer containing a blue-sensitive emulsion having associated therewith a yellow image dye-providing material, a red-sensitive silver halide emulsion having associated therewith a cyan image dye-providing material, and a green-sensitive emulsion having associated therewith a magenta image dye-providing material, and preferably all of said image dye-providing materials are initially immobile image dye-providing materials.

The terms "mobile" (or "diffusible") and "immobile" (or "nondiffusible") as used herein refer to compounds which are incorporated in the photographic element and, upon contact with an alkaline processing solution, are substantially diffusible or substantially immobile, respectively, in the hydrophilic colloid layers of a photographic element.

The term "image dye-providing material" as used herein is understood to refer to those compounds which are employed to form dye images in photographic elements. These compounds include dye developers, shifted dyes, color couplers, oxichromic compounds, dye redox releasers, etc.

In one preferred embodiment, the silver halide emulsions of the invention are used in association with immobile redox dye-releaser image dye-providing compounds. The immobile redox dye-releasers undergo oxidation followed, in certain instances, by hydrolysis to provide an imagewise distribution of a mobile image dye. Compounds of this type can be used with direct-positive emulsions to form negative image records in the exposed photographic element and will provide a positive image in diffusible dye for transfer to an image-receiving layer, such as in image-transfer film unit. Typical useful compounds of this type are disclosed in Whitmore et al Canadian Pat. No. 602,607, issued Aug. 2, 1960; Fleckenstein et al U.S. Ser. No. B 351,700, published Jan. 28, 1975; and U.S. Pat. Nos. 3,698,897, 3,728,552, 3,443,939, 3,443,940 and 3,443,941, and the like, all of which are incorporated herein by reference. Where the receiver layer is coated on the same support with the photosensitive silver halide layers, the support is preferably a transparent support, an opaque layer is preferably positioned between the image-receiving layer and the photosensitive silver halide layer, and the alkaline processing composition preferably contains an opacifying substance such as carbon or a pH-indicator dye which is discharged into the film unit between a dimensionally stable support or cover sheet and the photosensitive element.

In certain embodiments, the cover sheet can be superposed or is adapted to be superposed on the photosensitive element. The image-receiving layer can be located on the cover sheet so that it becomes an image-receiving element. In certain preferred embodiments where the image-receiving layer is located in the photosensitive element, a neutralizing layer is located on the cover sheet.

A means for containing the alkaline processing solution can be any means known in the art for this purpose, including rupturable containers positioned at the point of desired discharge of its contents into the film unit and adapted to be passed between a pair of juxtaposed rollers to effect discharge of the contents into the film unit, frangible containers positioned over or within the photosensitive element, hypodermic syringes, and the like.

It is known in the art that neutralizing layers containing acidic materials, such as polymeric acids, monomeric acids, hydrolyzable materials and the like, can be positioned within an image-transfer film unit to effect shutdown of development of silver halide and transfer of the image dye-providing substance. Neutralizing layers can also be used in the film units of the present invention, including acid layers positioned behind timing layers to delay neutralization of the element, acid layers positioned near the image-receiving layer, acid layers on a cover sheet used to distribute the processing composition uniformly over the photosensitive element, acid layers within the photosensitive element, and the like.

The photographic emulsions and elements of this invention are described by the generic designation direct-positive. The term "direct reversal" has recently been employed in the art to distinguish direct-positive emulsions and elements which contain unfogged silver halide grains and nucleating agents from direct-positive silver halide emulsions and elements containing surface fogged silver halide grains. It is to be understood that this invention is directed to direct-reversal photographic emulsions and elements.

The invention can be further illustrated by the following examples.

PREPARATION OF NUCLEATING AGENTS

EXAMPLE 1

5-(3-Ethyl-2-benzothiazolinylidene)-3-[4-(2-formylhydrazino)phenyl]rhodanine MW = 428.4 $C_{19}H_{16}N_4O_2S_3$

EXAMPLE 2

3-[4-(2-Formylhyrazino)phenyl]-5-[3-(3-sulfopropyl)-2-benzothiazolinylidene]rhodanine triethylamine salt MW = 623.8 $C_{26}H_{33}N_5O_5S_4$

EXAMPLE 3

3-[4-(2-Acetylhyrazino)phenyl]-5-[3-(3-sulfopropyl)-2-benzothiazolinylidene]rhodanine triethylamine salt MW = 637.8 $C_{27}H_{35}N_5O_5S_4$

EXAMPLE 4

3-[4-(2Benzoylhydrazino)phenyl]-5-(3-methyl-2-benzoxazolinylidene)rhodanine MW = 474.5 $C_{24}H_{18}N_4O_3S_2$

EXAMPLE 5

3-[4-(2-Formylhyrazino)phenyl]-5-(3-methyl-2-benzoxazolinylidene)rhodanine MW = 398.4 $C_{18}H_{14}N_4O_3S_2$

EXAMPLE 6

3-[4-(2-Acetylhydrazino)phenyl]-5-(3-methyl-2-benzoxazolinylidene)rhodanine MW = 412.5 $C_{19}H_{16}N_4O_3S_2$

EXAMPLE 7

5-[(3-Ethyl-2-benzoxazolinylidene)ethylidene]-3-[4-(2-formylhydrazino)phenyl]rhodanine MW = 438.5 $C_{21}H_{18}N_4O_3S_2$

EXAMPLE 8

3-[4-(2-Acetylhydrazino)phenyl]-5-[(3-ethyl-2-benzoxazolinylidene)ethylidene]rhodanine MW = 452.5 $C_{22}H_{20}N_4O_3S_2$

EXAMPLE 9

3-[4-(2-Benzoylhydrazino)phenyl]-5-[(3-ethyl-2-benzoxazolinylidene)ethylidene]rhodanine MW = 514 $C_{27}H_{22}N_4O_3S_2$

EXAMPLE 10

5-[(3-Ethyl-2-benzothiazolinylindene)ethylidene]-3-[4-(2-formylhydrazino)phenyl]rhodanine MW = 454 $C_{21}H_{18}N_4O_2S_3$

EXAMPLE 11

3-[4-(2-Acetylhydrazino)phenyl]-5-[(3-ethyl-2-benzothiazolinylidene)ethylidene]rhodanine MW = 468 $C_{22}H_{20}N_4O_2S_3$

EXAMPLE 12

3-[4-(2-Benzoylhydrazino)phenyl]-5-[(3-ethyl-2-benzothiazolinylidene)ethylidene]rhodanine MW = 530 $C_{27}H_{22}N_4O_2S_3$

EXAMPLE 13

3-[4-(2-Benzoylhydrazino)phenyl]-5-[(3-ethyl-2-benzothiazolinylidene]rhodanine MW = 504 $C_{25}H_{20}N_4O_2S_3$

EXAMPLE 14

5-(3-Ethyl-2-benzothiazolinylidene)-3-[3-(2-formylhydrazino)phenyl]rhodanine MW = 428.4 $C_{19}H_{16}N_4O_2S_3$

EXAMPLE 15

5-[(3-Ethyl-2-benzoxazolinylidene)ethylidene]-3-[3-(2-formylhydrazino)phenyl]rhodanine MW - 438.5 $C_{21}H_{18}N_4O_3S_2$

EXAMPLE 16

3-[4-(2-Formylhydrazino)phenyl]-5-(4-methylbenzylidene)rhodanine MW = 369.4 $C_{18}H_{15}N_3O_2S_2$

EXAMPLE 17

3-[4-(2-Formylhydrazino)phenyl]-5-(4-methoxybenzylidene)rhodanine MW = 385.4 $C_{18}H_{15}N_3O_3S_2$

EXAMPLE 18

3-[4-(2-Acetylhydrazino)phenyl]-5-(4-methylbenzylidene)rhodanine MW = 383.5 $C_{19}H_{17}N_3O_2S_2$

EXAMPLE 19

3-[4-(2-Acetylhydrazino)phenyl]-5-(4-methoxybenzylidene)rhodanine MW = 399.5 $C_{19}H_{17}N_3O_3S_2$ The synthetic details for preparing compounds of Examples 1–13 are contained in Table 1. In general, the appropriate rhodanine intermediate, reactant A, is suspended with a second intermediate, reactant B, in an organic solvent mixture. A base, usually triethylamine, is added and after a period of warming or refluxing with good stirring, the reaction mixture is chilled to precipitate the dye. The crude dye is filtered off and purified by recrystallization.

The reactants are listed below. Abbreviations used in the table are:

| | |
|---|---|
| $Et_3N$ = triethylamine | DMA = dimethylacetamide |
| DMF = dimethylformamide | MeCN = acetonitrile |
| EtOH = ethanol | Pyr = pyridine |
| MeOH = methanol | Pip = piperidine. |

The synthetic details for preparing the compounds of Examples 16–19 are summarized in Table 2. In general, the appropriate rhodanine intermediate, reactant A, and appropriate aldehyde, reactant C, were suspended in a solvent mixture of dimethylformamide (DMF) and ethanol. The reacton mixture was treated with the indicated base, refluxed a few minutes, chilled, and the dye collected by filtration. It was purified by recrystallization. Abbreviations for Table 2 are those indicated for Table 1.

| Reactants A | |
|---|---|
| RA-1 | 3-[4-(2-Formylhydrazino)phenyl]rhodanine |
| RA-2 | 3-[4-(2-Acetylhydrazino)phenyl]rhodanine |
| RA-3 | 3-[4-(2-Benzoylhydrazino)phenyl]rhodanine |
| RA-4 | 3-[3-(2-Formylhydrazino)phenyl]rhodanine |

| Reactants B | |
|---|---|
| RB-1 | 3-Ethyl-2-ethylthiobenzothiazolium Ethosulfate |
| RB-2 | Anhydro 2-Methylthio-3-(3-sulfopropyl)benzothiazolium Hydroxide |
| RB-3 | 3-Methyl-2-methylthiobenzoxazolium Fluorosulfonate |
| RB-4 | 2-(2-Acetanilidovinyl)-3-ethylbenzoxazolium Iodide |
| RB-5 | 2-(2-Acetanilidovinyl)-3-ethylbenzothiazolium Iodide |

| Reactants C | |
|---|---|
| RC-1 | p-tolualdehyde |
| RC-2 | p-anisaldehyde |

Table 1

| Example | Reactant A (moles) | Reactant B (moles) | Solvent ml | Base (moles) | Warming Temp ° C/ Time | Yield (Crude) | Recrystallization No. of Times | Soln./ Vol. Ratio | Yield (Purified) | m.p. ° C | λmax nm/ Soln. | εmax (×10⁴) |
|---|---|---|---|---|---|---|---|---|---|---|---|---|
| 1 | 1 10.0g (0.0375) | 1 17.4g (0.050) | DMF 35 EtOH 350 | $Et_3N$ 5.0g (0.050g) | 40–45° / 1½ hr. | 13.7 g (85%) | once | DMF-MeOH/ 1:4 | 9.6g (60%) | 303–305° (dec) | 428/ Pyr-MeOH | 6.12 |
| 2 | 1 1.00g (0.00375) | 2 1.51g (0.0050) | DMF 10 EtOH 50 | $Et_3N$ 0.50g (0.0050) | 50–55° */ 20 min. | 2.0g (85%) | once | DMF-EtOH/ 1:7 | 0.80g (34%) | 262–264° (dec) | 428/ DMF-MeOH | 6.23 |
| 3 | 2 1.05g (0.00375) | 2 1.51g (0.0050) | DMA 15 EtOH 45 | $Et_3N$ 0.50g (0.0050) | 50–55° */ 50 min. | 2.35g (85%) | once | DMA-EtOH/ 1:3 | 1.10g (46% | 293–295° (dec) | 428/ DMA-MeOH | 6.12 |
| 4 | 3 0.87g (0.0025) | 3 1.12g (0.0040) | MeCN 25 | $Et_3N$ 0.40g (0.0040) | 40–50° / 10 min. | 0.20g (17%) | once | DMF-EtOH/ 1:20 | 0.12g (10%) | 289–291° (dec) | 409/ DMF-MeOH | 5.00 |
| 5 | 1 1.00g (0.00375) | 3 1.57g (0.00563) | MeCN 50 | $Et_3N$ 0.50g (0.0050) | 40–50° / 15 min. | 1.0g (67%) | once | DMF-EtOH/ 1:4 | 0.60g (40%) | 280–282° (dec) | 409/ DMF-MeOH | 5.25 |
| 6 | 2 1.05g (0.00375) | 3 1.57g (0.00563) | MeCN 50 | $Et_3N$ 0.50g (0.0050) | 40–50° / 15 min. | 1.2g (78%) | once | DMA-EtOH/ 1:4 | 0.90g (59%) | 305–307° (dec) | 408/ DMA-MeOH | 5.03 |
| 7 | 1 0.267g (0.0010) | 4 0.434g (0.0010) | EtOH 20 | $Et_3N$ 0.12g (0.0012) | warmed/ 3–5min. | 0.30g (69%) | once | Pyr-EtOH-$H_2O$ | 0.20g (45%) | 274–276° (dec) | 492/ Pyr-MeOH | 9.59 |
| 8 | 2 1.05g (0.00375) | 4 1.63g (0.00375) | DMA 20 EtOH 40 | $Et_3N$ 0.50g (0.0050) | 40–45° / 10 min. | 1.35g (80%) | once | DMA-EtOH | 0.95g (55%) | 290–292° (dec) | 493/ Pyr-MeOH | 9.64 |
| 9 | 3 1.29g (0.00375) | 4 1.63g (0.00375) | DMF 10 EtOH 50 | $Et_3N$ 0.50g (0.0050) | 40–45° / 15 min. | 0.70g (36%) | once | DMF-EtOH | 0.45g (23%) | 235–237° (dec) | 494/ DMF-MeOH | 9.20 |
| 10 | 1 0.133g (0.0005) | 5 0.225g (0.0005) | MeCN 15 | $Et_3N$ 0.06g (0.0006) | warmed/ 3–5min. | 0.189g (83%) | once | Pyr-EtOH-$H_2O$ | 0.119g (53%) | 283–285° | 525/ Pyr-MeOH | 9.16 |
| 11 | 2 1.05g (0.00375) | 5 1.69g (0.00375) | MeCN 50 | $Et_3N$ 0.50g (0.0050) | 40–45° / 3–5min. | 1.60g (91%) | once | DMA-EtOH | 1.10g (63%) | 286–288° (dec) | 525/ Pyr-MeOH | 9.74 |
| 12 | 3 1.29g (0.00375) | 5 1.69g (0.00375) | MeCN 50 | $Et_3N$ 0.50g (0.0050) | 40–45° / 30 min. | 1.70g (85%) | once | DMF-EtOH | 1.05g (53%) | 277–279° (dec) | 522/ DMF MeOH | 9.43 |
| 13 | 3 1.29g (0.00375) | 1 1.74g (0.0050) | DMF 10 EtOH 50 | $Et_3N$ 0.50g (0.0050) | 40–45° */ 30 min. | 0.70g (37%) | once | DMF-EtOH | 0.50g (26%) | 328–330° (dec) | 428/ DMF-MeOH | 6.33 |
| 14 | 4 1.00g (0.00375) | 1 1.74g (0.0050) | DMF 12 EtOH 50 | $Et_3N$ 0.50g (0.0050) | 45–50° */ 30 min. | 1.00g (62%) | once | DMF-EtOH | 0.50g (31%) | 252–254° (dec) | 427/ DMF-MeOH | 5.86 |
| 15 | 4 1.50g (0.0056) | 4 2.40g (0.0056) | DMF 15 EtOH 60 | $Et_3N$ 0.75g (0.0075) | 40–45° **/ 30 min. | 1.30g (52%) | Once | PYR-EtOH $H_2O$ | 0.70g (28%) | 151–153° (dec) | 492/ DMF-MeOH | 7.63 |

*Another volume of EtOH was added to the reaction mixture after warming period prior to chilling.
**Water was added to precipitate the dye prior to chilling.

Table 2

| Example | Reactant A (moles) | Reactant C (moles) | Solvent (ml) | Base (drops) | Reflux Time | Crude Yield | Recrys. Solvent/ Vol. Ratio | Purified Yield | m.p. ° C | λmax nm/ Solv. | εmax (× 10⁴) |
|---|---|---|---|---|---|---|---|---|---|---|---|
| 16 | 1 1.00g (0.00375) | 1 0.45g (0.00375) | DMF(10) EtOH(50) | Pip (5) | 15 min. | 0.60g (44%) | DMF-EtOH/ 1:7 | 0.35g (25%) | 294–296 | 382/ DMF-MeOH | 3.8– |
| 17 | 1 1.00g (0.00375) | 2 0.51g (0.00375) | EtOH(60) | Pip (5) | 15 min. | 0.40g (28%) | DMF-EtOH/ 1:20 | 0.25g (17%) | 245–247 | 395/ DMF-MeOH | 3.43 |
| 18 | 2 1.05g (0.00375) | 1 0.45g (0.00375) | DMF(7) EtOH(53) | Pip (5) | 7 min. | 0.70g (49%) | DMF-EtOH/ 1:13 | 0.35g (24%) | 274–276 | 383/ DMF/ MeOH | 3.94 |
| 19 | 2 1.05g | 2 0.51g | DMF(7) EtOH(53) | Pip (5) | 7 min. | 0.60g (40%) | DMF-EtOH/ | 0.15g (10%) | 288–290 | 395/ DMF- | 3.49 |

Table 2-continued

| Example | Reactant A (moles) | Reactant C (moles) | Solvent (ml) | Base (drops) | Reflux Time | Crude Yield | Recrys. Solvent/ Vol. Ratio | Purified Yield | m.p. ° C | λmax nm/ Solv. | εmax (× $10^4$) |
|---|---|---|---|---|---|---|---|---|---|---|---|
| | (0.00375) | (0.00375) | | | | | 1:13 | | | MeOH | |

The following Examples 20 through 23 describe the preparation of materials used in preparing the compounds of Examples 1–19.

EXAMPLE 20

3-[4-(2-Acetylhydrazino)phenyl]rhodanine (Reactant A-2)

Sodium carbonate (1.06g. 0.010 mole) was dissolved in water (100 ml). Bis(carboxymethyl)trithiocarbonate (4.52g, 0.02 mole) was added portionwise with vigorous stirring. When solution was complete, the reaction mixture was warmed to 80°–85° C and 1-acetyl-2-(4-aminophenyl)hydrazine (3.30 g, 0.020 moles) was added in one portion. The reaction mixture was heated with stirring for 1½ hours, cooled to about 50°–60° C, then reheated at 80°–85° C. The product began to precipitate during reheating. After another 2 hours of heating the mixture was cooled to room temperature, chilled and filtered. The solid which was collected was washed with water and dried. Yield 2.95g (53%), mp 210°–213° C (dec).

EXAMPLES 21, 22 and 23

By analogous procedures, starting with 1-formyl-2-(4-aminophenyl)hydrazine, 1-benzoyl-2-(4-aminophenyl)hydrazine, and 1-formyl-2-(3-aminophenyl)hydrazine in place of 1-acetyl-2-(4-aminophenyl)hydrazine, Reactants A-1, A-3 and A-4, respectively, were obtained.

Preparation of 1-Acetyl-2-(4-aminophenyl)hydrazine

1-Acetyl-2-(4-nitrophenyl)hydrazine (12.7 g, 0.065 mole) and 10% palladium/charcoal (catalytic amount) was suspended in absolute ethanol (300 ml) in a Parr shaker bottle. The reaction mixture was hydrogenated at room temperature until hydrogen uptake ceased (theoretical uptake 15.6 psi-actual uptake was 17 psi).

The reaction mixture was filtered, the solvent was evaporated from the filtrate leaving a white crystalline powder. Yield 9.8g (92%), mp 140°–143° C.

Preparation of 1-Acetyl-2-(4-nitrophenyl)hydrazine

4-Nitrophenylhydrazine (15.0 g, 0.10 mole) and acetic acid (24.0 g, 0.40 mole) were mixed in a flask equipped with a stirrer and reflux condenser and heated at about 90° C for one hour. The solid mass was collected, washed with water, and then dissolved in hot ethanol. The resulting solution was chilled in ice to give tan needles. Yield 14.4 g (74%), mp 207°–209° C.

EXAMPLE 24

3-[4-(2-Acetylhydrazino)phenyl]-4-hydroxy-4-phenyl-thiazolidine-2-thione

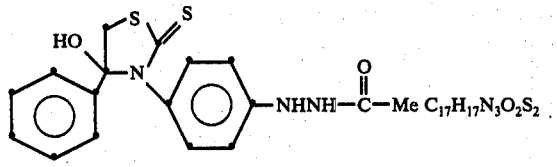

1-Acetyl-2-(4-aminophenyl)hydrazine (8.25 g., 0.05 mole) was added to a solution of potassium acetate (4.9 g., 0.05 mole) in methanol (50 ml). The temperature was maintained below 10° C throughout the remainder of the reaction. Carbon disulfide (3.8 g., 0.05 mole) mixed with methanol (5 ml) was added dropwise to the stirred suspension which was stirred for one hour. Phenacyl chloride (3.9 g., 0.02 mole) dissolved in methanol (15 ml) was added dropwise with stirring and the reaction mixture stirred for one and one-half hours. The resulting solution was allowed to warm to room temperature; most of the methanol was removed under vacuum. The solution was diluted with water. The product separated out as a white gummy material which crystallized on stirring and chilling. The white solid was collected by filtration, washed with water, and allowed to dry at room temperature. Yield 8.7 g (97%), m.p. 80°–84° C.

EXAMPLE 25

3-[4-(2-Acetylhydrazino)phenyl]-4-phenyl-4-thiazoline-2-thione

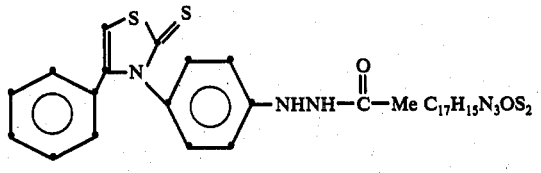

3-[4-(2-Acetylhydrazino)phenyl]-4-hydroxy-4-phenyl-thiazolidine-2-thione (1.0 g, 0.0028 mole) was added to water (25 ml) and methanol (5 ml). Concentrated hydrochloric acid (2 drops) was added; and the resulting mixture was stirred and heated at 80° C for 3 hours. The reaction mixture was chilled in ice, and the solid was filtered off. The product was washed with water, then ether, and allowed to dry. Yield 0.80 g (84%), m.p. 230°–232° C.

EXAMPLE 26

Comparison of single color photographic elements

A control integral, single color photographic element, Element 1, was prepared by coating the following layers in the order given on a poly(ethylene terephthalate) film support (coverages in parenthesis in g/m² unless indicated):

(1) image-receiving layer of poly[styrene-co-N-benzyl-N,N-dimethyl-N-(3-maleimidopropyl)ammonium chloride] (2.2) and gelatin (2.2).

(2) reflecting layer of titanium dioxide (21.5) and gelatin (2.2).

(3) opaque layer of carbon black (2.7) and gelatin (1.7).

(4) Compound CYD* (0.54) dispersed in gelatin (0.73).

(5) blue-sensitive, direct-positive, internal image gelatin-silver bromide emulsion of the type described in U.S. Pat. No. 3,761,276; (1.1 Ag, 2.2 gelatin), 5-sec-octadecylhydroquinone-2-sulfonic acid (20 g/mole silver) and fogging agent compound CNA[1]**(2000 mg/mole silver).

*Compound CYD

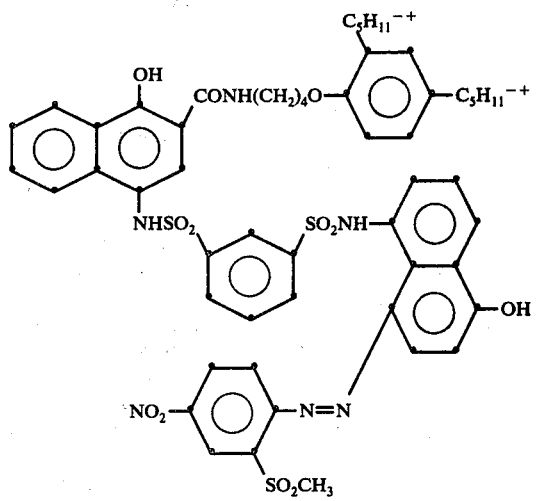

**Compound CNA[1] 1-Acetyl-2-{4-[5-amino-2-(2,4-di-t-pentylphenoxy)-benzoamido]phenyl}hydrazine, a ballasted analogue of the hydrazides of Whitmore U.S. Pat. No. 3,227,552.

Element 2 was identical to Element 1 except that the 2000 mg/mole of fogging agent CNA[1] was replaced with 6 mg/mole of the compound of Example 1.

The above-prepared photosensitive elements were then exposed to a tungsten light source through a graduated step tablet in a sensitometer. The following processing composition was employed in a pod and was spread between the photosensitive element and a transparent cover sheet described below at about 15° C and 38° C by passing the transfer "sandwich" between a pair of juxtaposed rollers so that the liquid layer was about 0.1 mm in thickness.

The cover sheet was prepared by coating in the order recited the following layers on a poly(ethylene terephthalate) support:

(1) a polyacrylic acid layer (15.5 g/m$^2$)

(2) a timing layer of a 95/5 mixture of cellulose acetate (40% acetyl) and poly(styrene-co-maleic anhydride) (4.3 g/m$^2$).

The processing composition was as follows:

| | |
|---|---|
| Potassium hydroxide | 56.0 g |
| 4-Hydroxymethyl-4-methyl-1-phenyl-3-pyrazolidone | 8.0 g |
| 5-Methylbenzotriazole | 2.4 g |
| t-Butylhydroquinone | 0.2 g |
| Sodium sulfite (anhyd) | 2.0 g |
| Carbon | 40.0 g |
| Hydroxyethylcellulose | 25.0 g |

-continued

| | |
|---|---|
| Water to make | 1.0 liter. |

The results of the reflection densitometry read from the cyan dye image on the receiving layer through the film support of the laminated sandwich are as follows.

The control coating I with 2000 mg/mole of nonadsorbed fogging agent CNA[1] gave a $D_{max}$ of 2.48, a $D_{min}$ of 0.16 and a relative speed of 100. The coating II containing the fogging agent of Example 1 at 3/1000 the amount of Compound CNA[1] gave excellent image discrimination: A $D_{max}$ of 2.15, a $D_{min}$ of 0.16 and relative speed of 41.

EXAMPLES 27–32

Comparison of multicolor photographic elements

A control integral multicolor photographic element, Element 3, was prepared by coating the following layers in the order given on a poly(ethylene terephthalate) film support (coverages in parenthesis in g/m$^2$ unless indicated):

(1) image-receiving layer of a poly[styrene-co-N-benzyl-N,N-dimethyl-N-vinylbenzyl-co-divinylbenzene] latex (2.2) and gelatin (2.2).

(2) reflecting layer of titanium dioxide (21.5) and gelatin (3.2).

(3) opaque layer of carbon black (2.7) and gelatin (1.7).

(4) cyan dye redox releaser Compound CYD (0.54) dispersed in gelatin (1.1).

(5) interlayer of gelatin (0.54).

(6) red-sensitive, direct-positive, internal image gelatin-silver bromide emulsion (1.2 Ag. 1.1 gelatin), 5-sec-octadecylhydroquinone-2-sulfonic acid (16 g/mole silver) and fogging agent CNA[1] (300 mg/mole silver).

(7) interlayer of gelatin (1.1) and 2,5-di-sec-dodecylhydroquinone (1.1).

(8) magenta dye redox releaser Compound MD* (p.54) in diethyllauramide (0.27) dispersed in gelatin (1.1).

(9) green-sensitive, direct-positive, internal image gelatin-silver bromide emulsion (1.35 Ag, 100 gelatin), 5-sec-octodecylhydroquinine-2-sulfonic acid (16 g/mole Ag), and fogging agent CNA[1] (400 mg/mole Ag).

(10) interlayer of gelatin (1.2) and 2,5-di-sec-dodecylhydroquinone (1.1).

(11) yellow dye redox releaser Compound YD** (0.86) in diethyllauramide (0.43) dispersion gelatin (1.1).

(12) blue-senstive, direct-positive, internal-image gelatin-silver bromide emulsion (1.25 Ag, 1.1 gelatin), 5-sec-octadecyl-5-hydroquinone-2-sulfonic acid (16 g/mole Ag), and fogging agent CNA[1] (500 g/mole Ag).

(13) overcoat layer of gelatin (0.54) and 2,5-di-sec-dodecylhydroquinone (0.11).

*Compound MD

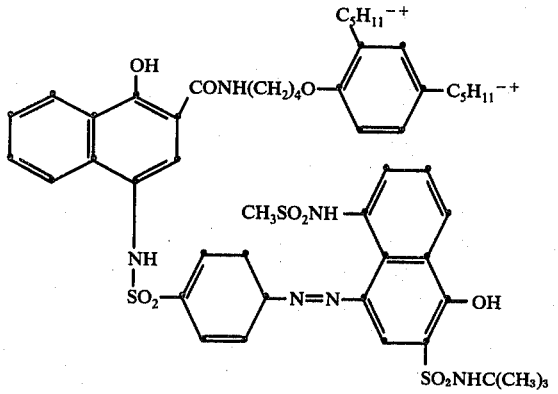

-continued

| | |
|---|---|
| Sodium sulfite (anhyd) | 2.0 g |
| Carbon | 100.0 g |
| Carboxymethylcellulose | 51.0 g |
| Water to make | 1.0 liter. |

Table 3 shows the maximum (Dmax) and minimum (Dmin) dye densities in the image-receiving layer as read by reflection densitometry through the film support of the laminate. The speed values were taken at a density of 0.7 on the reversal sensitometric curve.

Table 3

| Compound of Example | Concentration mg/mole Ag | | | Dmax | | | Dmin | | |
|---|---|---|---|---|---|---|---|---|---|
| | Blue | Green | Red | Blue | Green | Red | Blue | Green | Red |
| CNA[1] (control) | 500 | 400 | 300 | 0.53 | 0.74 | 0.40 | 0.20 | 0.20 | 0.17 |
| 1 | 15 | 10 | 8 | 1.58 | 0.96 | 1.33 | 0.26 | 0.22 | 0.18 |
| 13 | 29 | 19 | 10 | 1.80 | 0.94 | 1.66 | 0.41 | 0.26 | 0.18 |
| 5 | 11 | 7 | 6 | 1.59 | 1.99 | 1.66 | 0.28 | 0.42 | 0.20 |
| 6 | 38 | 21 | 13 | 1.70 | 1.20 | 1.60 | 0.36 | 0.28 | 0.19 |
| 4 | 19 | 12 | 8 | 1.78 | 1.21 | 1.69 | 0.38 | 0.26 | 0.18 |

EXAMPLE 33

Comparison of nucleating agents

A series of integral, single-color photographic elements were prepared by coating the following layers in the order given on a poly(ethylene terephthalate) film support (coverages in parenthesis in g/m² unless indicated):

1. image receiving layer of poly[styrene-co-N-vinylbenzyl-N-benzyl-N,N-dimethylammonium chloride-co-divinylbenzene] (2.7) and gelatin (2.7).
2. reflecting layer of titanium dioxide (16.2) and gelatin (2.6).
3. opaque layer of carbon black (1.9) and gelatin (1.2)
4. Compound of CYD (0.54) dispersed in gelatin (1.1).
5. interlayer of gelatin (0.54).
6. blue-sensitive internal-image gelatin-silver bromide emulsion (1.4 Ag 1.6 gelatin) of the type described in Example 9 of U.S. Pat. No. 3,761,276, 5-sec-octadecylhydroquinone-2-sulfonic acid (16 g/mole silver) and nucleating agent as indicated in Table 4.

The above-prepared photosensitive elements were then exposed to a tungsten light source through a 21-step graduated step-tablet in a sensitometer. The following processing composition was employed in a pod and was spread between the photosensitive element and the transparent cover sheet described below at about 15° C by passing the transfer "sandwich" between a pair of

**Compound YD

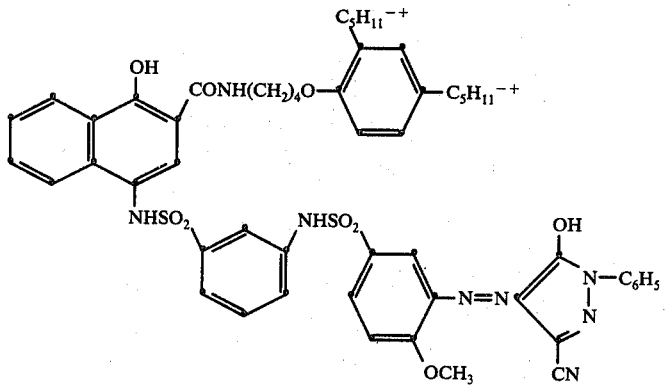

A series of analogous photographic elements, Elements 4 through 8, were prepared by substituting the heterocyclic N-(acylhydroazinophenyl)thioamide fogging agents of the invention for fogging agent CNA[1] in the emulsion layers 12 (blue-sensitive), 9 (green-sensitive), and 6 (red-senstive).

The above-prepared photosensitive elements were then exposed to a graduated density multicolor test object. The following processing composition was employed in a pod and was spread between duplicate samples of the photosensitive element and the transparent cover sheet described below — one at 15° C, the other at 38° C — by passing the transfer "sandwich" between a pair of juxtaposed rollers so that the liquid layer was about 70 microns in thickness.

The cover sheet was identical to that employed above in Example 26.

The processing composition was as follows:

| | |
|---|---|
| Potassium hydroxide | 56.0 g |
| 4-Hydroxymethyl-4-methyl-1-phenyl-3-pyrazolidone | 8.0 g |
| 5-Methylbenzotriazole | 2.4 g |
| t-Butylhydroquinone | 0.2 g |

juxtaposed rollers so that the liquid layer was about 0.1 mm.

The cover sheet was prepared by coating the following layers on a poly(ethylene terephthalate) support:

1. a polyacrylic acid layer (16.0)
2. a timing layer of a 95/5 mixture of cellulose acetate (40% acetyl) and poly(styrene-co-maleic anhydride) (4.3). The processing composition contained:

| | | |
|---|---|---|
| Potassium hydroxide | 40 | g |
| 4-Hydroxymethyl-4-methyl-1-phenyl-3-pyrazolidone | 7.2 | g |
| 5-Methylbenzotriazole | 2.2 | g |
| t-Butylhydroquinone | 0.18 | g |
| Sodium sulfite (anhyd) | 1.8 | g |
| Carbon | 171.0 | g |
| Tamol SN® dispersant* | 2.2 | g |
| Carboxymethylcellulose | 44.0 | g |
| Water to make | 1.0 | l. |

The results of the reflection sensitometry read from the cyan dye image on the receiving layer through the film support of the laminated sandwich are shown in Table 4.

Table 4

| Nucleating Agent | Conc. (mg/mole Ag) | Cyan Dye Density Max. | 11th step | Min. | Rel. Speed |
|---|---|---|---|---|---|
| CNA[1] | 2000 | 2.30 | 2.04 | 0.22 | 100 |
| CNA[2] | 1000 | 2.34 | 2.31 | 0.22 | 48 |
| Ex. 1 | 5 | 1.92 | 0.42 | 0.23 | 330 |
| Ex. 1 | 10 | 2.32 | 1.60 | 0.23 | 125 |
| CNA[3] | 10 | 0.34 | 0.22 | 0.22 | —* |
| CNA[3] | 100 | 2.16 | 2.08 | 0.26 | 22 |
| CNA[4] | 100 | 0.40 | 0.34 | 0.22 | —* |

*no image discrimination

Compound CNA[1] 1-Acetyl-2-{4-[5-amino-2-(2,4-di-t-pentylphenoxy)benzoamido]-phenyl}hydrazine, a ballasted analogue of the hydrazides of Whitmore U.S. Pat. 3,227,552.

Compound CNA[2] 1-Formyl-2-(4-methylphenyl)hydrazine, U.S. Pat. 3,227,552.

Compound CNA[3] 3,3'-Bis[3-(phenylhydrazono)propyl]thiacarbocyanine bromide (U.S. Pat. 3,718,470).

Compound CNA[4] 2-Methyl-3-[3-(p-sulfophenylhydrazono)propyl]benzothiazolium bromide (U.S. Pat. 3,615,615).

The nucleating agent of Example 1 at 10 mg/mole silver gave high $D_{max}$ (maximum development of silver in the unexposed areas) and slightly better speed than the ballasted prior art nucleating agent CNA[1] of the type described by Whitmore, U.S. Pat. No. 3,227,552, used at a 200× greater concentration level. At 5 mg/mole the lower level of nucleating agent gave speed, but at the cost of a lower $D_{max}$. The prior art cyanine dye nucleating agent CNA[3] gave insignificant nucleation at 10 mg/mole but was of sufficient activity at 100 mg/mole to give densities similar to those of CNA[1]. Compound CNA[4] gave no image discrimination at 10 or 100 mg/mole under the conditions of the experiment.

EXAMPLES 34–39

Comparisons of Additional Nucleating Agents

Example 33 was repeated using the nucleating agents set forth below in Table 5, and using both the previously noted 15° C temperatures and 38° C temperature substituted therefor. The results show nucleating agents of the type embraced by formula (I) to be effective nucleating agents both at 15° C and 38° C.

Table 5

| Nucleating Agent | Conc. (mg/mole Ag) | Cyan Dye Density 15° C Dmax | 15° C Dmin | 38° C Dmax | 38° C Dmin |
|---|---|---|---|---|---|
| CNA[1] | 1000 | 1.50 | 0.17 | 2.10 | 0.22 |

Table 5-continued

| Nucleating Agent | Conc. (mg/mole Ag) | Cyan Dye Density 15° C Dmax | 15° C Dmin | 38° C Dmax | 38° C Dmin |
|---|---|---|---|---|---|
| Ex. 1 (Reactant A-1) | 10 | 0.82 | 0.17 | 1.88 | 0.30 |
| Ex. 21 (Reactant A-2) | 4 | 1.74 | 0.17 | 2.04 | 0.34 |
| Ex. 20 (Reactant A-3) | 4 | 1.19 | 0.18 | 1.37 | 0.23 |
| Ex. 22 | 4 | 0.89 | 0.17 | 1.22 | 0.32 |
| Ex. 24 | 8 | 1.39 | 0.18 | 1.90 | 0.24 |
| Ex. 25 | 16 | 1.46 | 0.17 | 2.00 | 0.24 |
| None | — | — | No image | ($D_{min}$) | — |

The invention has been described in detail with particular reference to preferred embodiments thereof, but it will be understood that variations and modifications can be effected within the spirit and scope of the invention.

We claim:

1. A radiation-sensitive silver halide emulsion comprising silver halide grains capable of forming an internal latent image when coated on a photographic element and exposed to actinic radiation and, adsorbed to the surface of said silver halide grains, a nucleating amount of a heterocyclic N-(acylhydrazinophenyl)thioamide nucleating agent having the formula

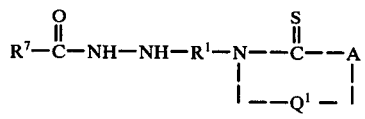

wherein:

$R^1$ is a phenylene group;

A is $=N-R^2$, $-S-$ or $-O-$;

$Q^1$ represents the atoms necessary to complete a five-membered heterocyclic nucleus;

$R^2$ and $R^7$ are independently chosen from hydrogen, phenyl, alkyl, alkylphenyl and phenylalkyl; and said alkyl moieties in each instance include from 1 to 6 carbon atoms.

2. A radiation-sensitive silver halide emulsion according to claim 1 wherein said silver halide grains contain a metal dopant.

3. A radiation-sensitive silver halide emulsion according to claim 1 wherein said nucleating agent is a cyanine dye.

4. A radiation-sensitive silver halide emulsion according to claim 1 wherein said nucleating agent is a benzylidene dye.

5. A radiation-sensitive silver halide emulsion according to claim 1 wherein said nucleating agent is present in a concentration of from 0.1 to 50 mg per mole of silver.

6. A radiation-sensitive silver halide emulsion according to claim 1 wherein $R^1$ is a meta- or para-phenylene group.

7. A radiation-sensitive silver halide emulsion according to claim 1 wherein $Q^1$ is represented by the formula

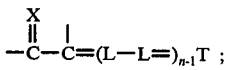

wherein

L is a methine group;

X is =S or =O;

T is

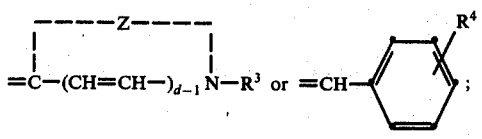

$R^3$ is an alkyl substituent;
$R^4$ is an alkyl,

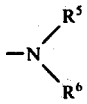

or alkoxy group;

Z represents the nonmetallic atoms necessary to complete a basic heterocyclic nucleus of the type found in cyanine dyes;

*n* and *d* are independently chosen from the integers 1 and 2;

$R^5$ and $R^6$ are independently chosen from hydrogen, phenyl, alkyl, alkylphenyl and phenylalkyl; and the alkyl moieties in each instance include from 1 to 6 carbon atoms.

8. A radiation-sensitive silver halide emulsion according to claim 1 wherein $Q^1$ is represented by the formula

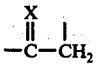

wherein

X is =O or =S.

9. A radiation-sensitive silver halide emulsion according to claim 1 wherein the heterocyclic thioamide ring is a rhodanine, isorhodanine, 2-thiohydantoin or 2-thio-2,4-oxazolidinedione ring.

10. A radiation-sensitive silver halide emulsion according to claim 1 wherein $R^7$ is hydrogen, an alkyl group having from 1 to 4 carbon atoms or a phenyl group.

11. A radiation-sensitive silver halide emulsion according to claim 1 wherein said nucleating agent is present in a concentration of from 0.5 to 25 mg per mole of silver.

12. A radiation-sensitive silver halide emulsion comprising silver halide grains capable of forming an internal latent image when coated on a photographic element and exposed to actinic radiation and, adsorbed to the surface of said silver halide grains, a nucleating amount of a heterocyclic N-(acylhydrazinophenyl)thioamide nucleating agent having the formula

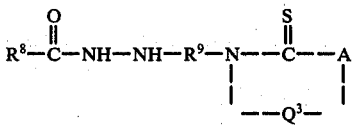

wherein:

A is $=N-R^2$, —S— or —O—;

$Q^3$ is represented by the formula

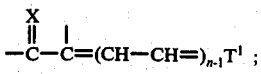

X is =S or =O;

$T^1$ is

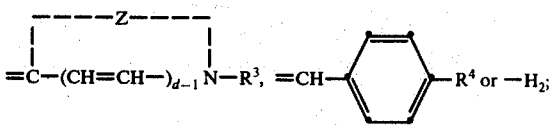

$R^3$ is an alkyl substituent;
$R^4$ is an alkyl,

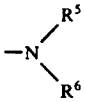

or alkoxy substituent;

Z represents the nonmetallic atoms necessary to complete a basic heterocyclic nucleus of the type found in cyanine dyes having ring-forming atoms chosen from the class consisting of carbon, nitrogen, oxygen, sulfur and selenium;

*n* and *d* are independently chosen from the integers 1 and 2;

$R^8$ is hydrogen, phenyl, methyl, ethyl, propyl or butyl;

$R^9$ is a meta- or para-phenylene group;

$R^2$, $R^5$ and $R^6$ are independently chosen from hydrogen, phenyl, alkyl, alkylphenyl and phenylalkyl; and said alkyl moieties in each instance include from 1 to 6 carbon atoms.

13. A radiation-sensitive silver halide emulsion according to claim 12 wherein the heterocyclic thioamide ring is a rhodanine, isorhodanine, 2-thiohydrantoin or 2-thio-2,4-oxazolidinedione.

14. A radiation-sensitive silver halide emulsion according to claim 12 wherein said nucleating agent is present in a concentration of from 0.5 to 25 mg per mole of silver.

15. A radiation-sensitive silver halide emulsion according to claim 14 wherein said nucleating agent is present in a concentration of less than 15 mg per mole of silver.

16. A radiation-sensitive silver halide emulsion according to claim 14 wherein said nucleating agent is chosen from the class consisting of 5-(3-ethyl-2-benzothiazolinylidene)-3-[4-(2-formylhydrazino)phenyl]rhodanine;

3-[4-(2-formylhydrazino)phenyl]-5-[3-(3-sulfopropyl)-2-benzothiazolinylidene]rhodanine triethylamine salt;

3-[4-(2-acetylhydrazino)phenyl]-5-[3-(3-sulfopropyl)-2-benzothiazolinylidene]rhodanine triethylamine salt;

3-[4-(2-benzoylhydrazino)phenyl]-5-(3-methyl-2-benzoxazolinylidene)rhodanine;

3-[4-(2-formylhydrazino)phenyl]-5-(3-methyl-2-benzoxazolinylidene)rhodanine;

3-[4-(2-acetylhydrazino)phenyl]-5-(3-methyl-2-benzoxazolinylidene)rhodanine;

5-[(3-ethyl-2-benzoxazolinylidene)ethylidene]-3-[4-(2-formylhydrazino)phenyl]rhodanine;
3-[4-(2-acetylhydrazino)phenyl]-5-[(3-ethyl-2-benzoxazolinylidene)ethylidene]rhodanine;
3-[4-(2-benzoylhydrazino)phenyl]-5-[(3-ethyl-2-benzoxazolinylidene)ethylidene]rhodanine;
5-[(3-ethyl-2-benzothiazolinylidene)ethylidene]-3-[4-(2-formylhydrazino)phenyl]rhodanine;
3-[4-(2-acetylhydrazino)phenyl]-5-[(3-ethyl-2-benzothiazolinylidene)ethylidene]rhodanine;
3-[4-(2-benzolyhydrazino)phenyl]-5-[(3-ethyl-2-benzothiazolinylidene)ethylidene]rhodanine;
3-[4-(2-benzoylhydrazino)phenyl]-5-(3-ethyl-2-benzothiazolinylidene)rhodanine;
5-(3-ethyl-2-benzothiazolinylidene)-3-[3-(2-formylhydrazino)phenyl]rhodanine; and
5-[(3-ethyl-2-benzoxazolinylidene)ethylidene]-3-[3-(2-formylhydrazino]rhodanine.

17. A radiation-sensitive silver halide emulsion according to claim 14 wherein said nucleating agent is chosen from the class consisting of
3-[4-(2-formylhydrazino)phenyl]-5-(4-methylbenzylidene)rhodanine;
3-[4-(2-formylhydrazino)phenyl]-5-(4-methoxybenzylidene)rhodanine;
3-[4-(2-acetylhydrazino)phenyl]-5-(4-methylbenzylidene)rhodanine; and
3-[4-(2-acetylhydrazino)phenyl]-5-(4-methoxybenzylidene)rhodanine.

18. A radiation-sensitive silver halide emulsion according to claim 14 wherein said nucleating agent is chosen from the class consisting of
3-[4-(2-formylhydrazino)phenyl]rhodanine;
3-[4-(2-acetylhydrazino)phenyl]rhodanine;
3-[4-(2-acetylhydrazino)phenyl]-4-hydroxy-4-phenylthiazolidine-2-thione;
3-[4-(2-acetylhydrazino)phenyl]-4-phenyl-4-thiazoline-2-thione;
3-[4-(2-benzoylhydrazino)phenyl]rhodanine and
3-[3-(2-formylhydrazino)phenyl]rhodanine.

19. A radiation-sensitive silver halide emulsion comprising
(1) monodispersed silver halide grains having metal dopants occluded therein and wherein said halide is predominantly bromide, which grains have been chemically sensitized on the surface thereof to a level which would produce a density of less than 0.4 when imagewise exposed and developed in a test surface developer for five minutes at 27° C, and to at least a level which would provide a density of greater than 0.5 in an undoped silver halide emulsion of the same grain size and halide composition when exposed and developed in the test surface developer, provided said emulsions are coated at a coverage of between about 3 and 4 grams per square meter; and
(2) adsorbed to the surface of said silver halide grains, 0.5 to 25 mg per mole of silver of a heterocyclic N-(acylhydrazinophenyl)thioamide nucleating agent having the formula

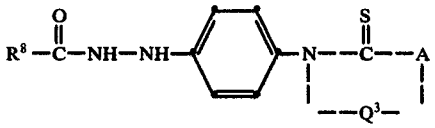

wherein:
A is $=N-R^2$, —S— or —O—;
$Q^3$ is represented by the formula

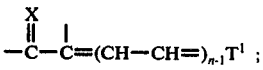

X is =S or =O;
$T^1$ is

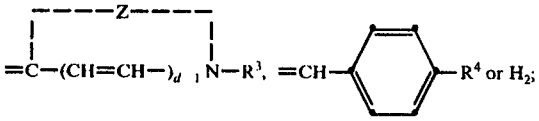

$R^3$ is an alkyl substituent;
$R^4$ is an alkyl

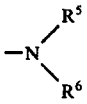

or alkoxy substituent;
Z represents the nonmetallic atoms necessary to complete a basic heterocyclic nucleus of the type found in cyanine dyes having ring-forming atoms chosen from the class consisting of carbon, nitrogen, oxygen, sulfur and selenium;
n and d are independently chosen from the integers 1 and 2;
$R^8$ is hydrogen, phenyl, methyl, ethyl, propyl or butyl;
$R^2$, $R^5$ and $R^6$ are independently chosen from hydrogen, phenyl, akyl, alkylphenyl and phenylalkyl;
said alkyl moieties in each instance include from 1 to 6 carbon atoms; and
wherein the surface developer composition consists essentially of

| | | |
|---|---|---|
| water (52° C) | 500.0 | cc |
| N-methyl-p-aminophenol sulfate | 2.5 | grams |
| sodium sulfite, desiccated | 30.0 | grams |
| hydroquinone | 2.5 | grams |
| sodium metaborate | 10.0 | grams |
| potassium bromide | 0.5 | gram |
| water to make 1 liter. | | |

20. A photographic element comprising a support and, as a coating thereon, at last one radiation-sensitive silver halide emulsion layer comprised of silver halide grains capable of forming an internal latent image when coated in a photographic element and exposed to actinic radiation and, adsorbed to the surface of said silver halide grains, a nucleating amount of a heterocyclic N-(acylhydrazinophenyl)thioamide nucleating agent having the formula

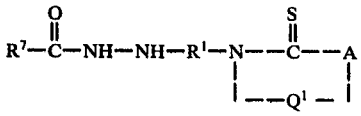

wherein:
$R^1$ is a phenylene group;
A is a $=N-R^2$, —S— or —O—;

$Q^1$ represents the atoms necessary to complete a five-membered heterocyclic nucleus;

$R^2$ and $R^7$ are independently chosen from hydrogen, phenyl, alkyl, alkylphenyl and phenylalkyl; and said alkyl moieties in each instance include from 1 to 6 carbon atoms.

21. A photographic element according to claim 20 wherein said silver halide grains contain a metal dopant.

22. A photographic element according to claim 20 wherein said nucleating agent is a cyanine dye.

23. A photographic element according to claim 20 wherein said nucleating agent is a benzylidene dye.

24. A photographic element according to claim 20 wherein said nucleating agent is present in a concentration of from 0.1 to 50 mg per mole of silver.

25. A photographic element according to claim 20 wherein $R^1$ is a meta- or para-phenylene group.

26. A photographic element according to claim 20 wherein $Q^1$ and A are chosen to complete a rhodanine ring.

27. A photographic element according to claim 20 wherein A and $Q^1$ are chosen to complete a thiazoline ring.

28. A photographic element according to claim 20 wherein $Q^1$ is represented by the formula

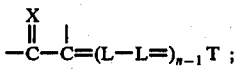

wherein

L is a methine group;

X is =S or =O;

T is

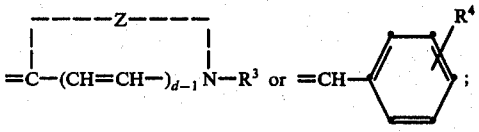

$R^3$ is an alkyl substituent;

$R^4$ is hydrogen; an alkyl group;

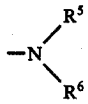

or an alkoxy group;

Z represents the nonmetallic atoms necessary to complete a basic heterocyclic nucleus of the type found in cyanine dyes;

*n* and *d* are independently chosen from the integers 1 and 2;

$R^5$ and $R^6$ are independently chosen from hydrogen, phenyl, alkyl, alkylphenyl and phenylalkyl; and the alkyl moieties in each instance include from 1 to 6 carbon atoms.

29. A photographic element according to claim 20 wherein $Q^1$ is represented by the formula

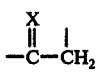

wherein

X is =O or =S.

30. A photographic element according to claim 20 wherein said nucleating agent is present in a concentration of from 0.5 to 25 mg per mole of silver.

31. A photographic element according to claim 20 wherein said silver halide grains contain a metal dopant therein; provide a density of from 3 to 4 grams/m$^2$, exposed to a light intensity scale for a fixed time of from $1 \times 10^{-2}$ to 1 second and developed for 5 minutes at 25° C in a test surface developer; and provide a maximum optical density at least five times greater than the above maximal optical density when the above procedure is repeated additionally including in the surface developer 0.5 gram per liter of potassium iodide to form an internal developer; wherein said test surface developer composition consists essentially of

| | |
|---|---|
| Water (52° C) | 500.0 cc |
| N-methyl-p-aminophenol sulfate | 2.5 grams |
| sodium sulfite (anhyd.) | 30.0 grams |
| hydroquinone | 2.5 grams |
| sodium metaborate | 10.0 grams |
| potassium bromide | 0.5 gram |
| water to make 1.0 liter. | |

32. A photographic element comprising a support and, as a coating thereon, at least one radiation-sensitive silver halide emulsion layer comprised of silver halide grains containing a metal dopant therein which provide a maximum optical density less than 0.25 when coated on a support at a density of from 3 to 4 grams per square meter, exposed to a light intensity scale for a fixed time of $1 \times 10^{-2}$ to 1 second and developed for 5 minutes at 25° C in a surface developer of the composition indicated below and which provide a maximum optical density at least five times greater than the above maximum optical density when the above procedure is repeatedly additionally including in the surface developer 0.5 gram per liter of potassium iodide to form an internal developer and, adsorbed to the surface of said silver halide grains, from 0.5 to 25 mg per mole of silver of a heterocyclic N-(acylhydrazinophenyl)thioamide nucleating agent of the formula

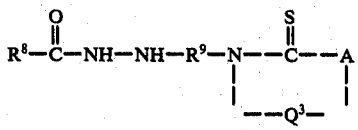

wherein:

A is =N—$R^2$, —S— or —O—;

$Q^3$ is represented by the formula

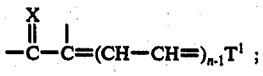

X is =S or =O;

$T^1$ is:

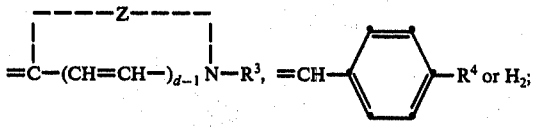

$R^3$ is an alkyl substituent;

$R^4$ is an alkyl,

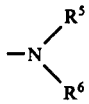

or alkoxy substituent;

Z represents the nonmetallic atoms necessary to complete a basic heterocyclic nucleus of the type found in cyanine dyes having ring-forming atoms chosen from the class consisting of carbon, nitrogen, oxygen, sulfur and selenium;

*n* and *d* are independently chosen from the integers 1 and 2;

$R^8$ is hydrogen, phenyl, methyl, ethyl, propyl or butyl;

$R^9$ is a meta- or para-phenylene group;

$R^2$, $R^5$ and $R^6$ are independently chosen from hydrogen, phenyl, alkyl, alkylphenyl and phenylalkyl;

said alkyl moieties in each instance include from 1 to 6 carbon atoms; and wherein the surface developer composition consists essentially of

| | |
|---|---|
| water (52° C) | 500.0 cc |
| N-methyl-p-aminophenol sulfate | 2.5 grams |
| sodium sulfite, desiccated | 30.0 grams |
| hydroquinone | 2.5 grams |
| sodium metaborate | 10.0 grams |
| potassium bromide | 0.5 gram |
| water to make 1 liter. | |

33. A photographic element according to claim 32 wherein said radiation-sensitive layer additionally includes a hydrophilic colloid.

34. A photographic element according to claim 32 wherein said nucleating agent is present in a concentration of from 1 to 15 mg per mole of silver.

35. A photographic element according to claim 32 wherein the heterocyclic thioamide nucleus is a rhodanine ring.

36. A photographic element according to claim 32 wherein said radiation-sensitive layer additionally contains at least one other hydrazine nucleating means, hydrazone nucleating means or N-substituted cycloammonium quaternary salt nucleating means dispersed therein.

37. In an image transfer film unit which comprises an image-receiving layer, at least one layer of a photographic emulsion containing silver halide grains which are substantially unfogged on their surfaces and which are capable of forming an internal latent image, means containing and capable of selectively introducing an alkaline processing composition into contact with said photographic emulsion layer, and a silver halide developing agent, the improvement comprising a nucleating amount of a heterocyclic N-(acylhydrazinophenyl)thioamide nucleating agent incorporated within said photographic emulsion layer having the formula

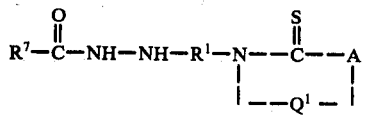

wherein:

$R^1$ is a phenylene group;

A is $=N-R^2$, —S— or —O—;

$Q^1$ represents the atoms necessary to complete a five-membered heterocyclic nucleus;

$R^2$ and $R^7$ are independently chosen from hydrogen, phenyl, alkyl, alkylphenyl and phenylalkyl; and said alkyl moieties in each instance include from 1 to 6 carbon atoms.

38. In an image transfer film unit according to claim 37 the further improvement in which said film unit incorporates an antifoggant.

39. In an image transfer film unit according to claim 37 the further improvement in which said film unit additionally includes hydrazide, hydrazone or quaternary ammonium salt nucleating means.

40. An image transfer film unit comprising (a) a photographic element including (1) a layer containing a blue-sensitive silver halide emulsion having associated therewith an immobile material capable of releasing a mobile yellow image dye, (2) a layer containing a green-sensitized silver halid emulsion having associated therewith an immobile material capable of releasing a mobile magenta image dye, and (3) a layer containing a red-sensitized silver halide emulsion having associated therewith an immobile material capable of releasing a mobile cyan image dye, wherein each of said silver halide emulsions comprises silver halide grains having metal dopants occluded therein, said grains being substantially unfogged on their surfaces and being chemically sensitized on their surfaces (i) to a level which will provide a maximum density of less than 0.4 when developed in a test surface developer of the composition indicated below for 5 minutes at 27° C after exposure to a light intensity scale for a fixed time of from $1 \times 10^{-2}$ to 1 second when said photosensitive composition is coated at a coverage of between about 3 and 4 g of silver per square meter, and (ii) to at least a level which would provide a maximum density of at least 0.5 using undoped silver halide grains of the same grain size and halide composition when coated, exposed and developed in like manner.

(b) an image-receiving layer, (c) means containing and adapted for introducing an alkaline processing composition into contact with said silver halide emulsions, (d) a silver halide surface developing agent located in said processing composition or said photographic element, and (e) from 0.5 to 25 mg per mole of silver of a nucleating agent incorporated within at least one of said silver halide emulsion layers, said nucleating agent having the formula

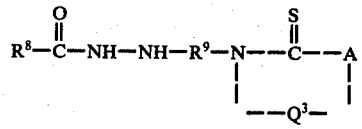

wherein:

A is $=N-R^2$, $-S-$ or $-O-$;

$Q^3$ is represented by the formula

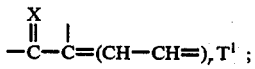

X is $=S$ or $=O$;

$T^1$ is

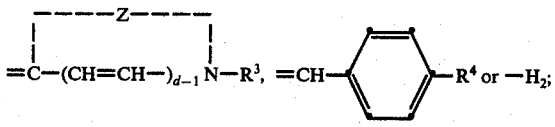

$R^3$ is an alkyl substituent;

$R^4$ is an alkyl,

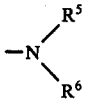

or alkoxy substituent;

Z represents the nonmetallic atoms necessary to complete a basis heterocyclic nucleus of the type found in cyanine dyes having ring-forming atoms chosen from the class consisting of carbon, nitrogen, oxygen, sulfur and selenium;

*n* and *d* are independently chosen from the integers 1 and 2;

$R^8$ is hydrogen, phenyl, methyl, ethyl, propyl or butyl;

$R^9$ is a meta- or para-phenylene group;

$R^2$, $R_5$ and $R^6$ are independently chosen from hydrogen, phenyl, alkyl, alkylphenyl and phenylalkyl;

said alkyl moieties in each instance include from 1 to 6 carbon atoms;

the test surface developer consisting essentially of:

| | |
|---|---|
| Water (53° C) | 500.0 cc |
| N-methyl-p-aminophenol sulfate | 2.5 grams |
| sodium sulfite, desiccated | 30.0 grams |
| hydroquinone | 2.5 grams |
| sodium metaborate | 10.0 grams |
| potassium bromide | 0.5 gram |
| water to make 1 liter. | |

41. An image transfer film unit according to claim 40 wherein $R^9$ is a para-phenylene group.

* * * * *

UNITED STATES PATENT AND TRADEMARK OFFICE

CERTIFICATE OF CORRECTION

PATENT NO. :4,080,207

DATED :March 21, 1978

INVENTOR(S) :Ronald E. Leone and James K. Elwood

It is certified that error appears in the above-identified patent and that said Letters Patent are hereby corrected as shown below:

Column 2, line 55, "discoses" should read --discloses a--. Column 6, lines 39-40, "6-hydroxypyridine" (second occurrence) should be deleted. Column 7, line 49, that part of the formula reading "(CH=CH-)" should read --(CH-CH=)--. Column 10, Table 1, that part of NA-13 reading "Dimethylbenoyl" should read --Dimethylbenzoyl--; line 63, "to" (second occurrence) should be deleted. Column 11, line 34, "invetion" should read --invention--; line 55, "halaide" should read --halide--. Column 12, line 33, "gain" should read --grain--; line 55, "which" should read --while--. Column 19, line 15, "U.s." should read --U.S.--. Column 20, line 26, after "as in", --an-- should be inserted. Column 22, line 2, that part of the formula reading "benzothiazolinylindene" should read --benzothiazolinylidene--. Column 23, line 3, "reacton" should read --reaction--. Column 28, line 16, "41" should read --42--; line 41, "Ag." should read --Ag,--; line 48, "(p.54)" should read --(0.54)--; line 60, "dispersion" should read --dispersed in--. Column 29, line 49, that part of the formula reading "(acylhydroazinophenyl)" should read --(acylhydrazinophenyl)--; line 52, "(red-senstive)" should read --(red-sensitive)--. Column 30, line 59, after "Ag", --,-- should be inserted. Column 31, line 18, after the list of processing composition contents, --*A sodium salt of a sulfonated naphthalene-formaldehyde condensate sold by Rohm and Haas as a dispersant.-- should be inserted; line 60, "temperature" should read --temperatures--. Column 35, line 11, that part of the formula

UNITED STATES PATENT AND TRADEMARK OFFICE

CERTIFICATE OF CORRECTION

PATENT NO. : 4,080,207 Page 2 of 2

DATED : March 21, 1978

INVENTOR(S) : Ronald E. Leone and James K. Elwood

It is certified that error appears in the above-identified patent and that said Letters Patent are hereby corrected as shown below:

reading "benzolyhydrazino" should read --benzoylhydrazino--. Column 36, line 37, "akyl" should read --alkyl--. Column 40, line 31, "halid" should read --halide--. Column 41, line 17, that part of the formula reading "$CH=)_rT^1$" should read --$CH=)_nT^1$--. Column 42, line 9, "basis" should read --basic--; line 18, "$R_5$" should read --$R^5$--.

Signed and Sealed this

Third Day of April 1979

[SEAL]

Attest:

RUTH C. MASON
Attesting Officer

DONALD W. BANNER
Commissioner of Patents and Trademarks